US005651683A

United States Patent [19]

Shimamura et al.

[11] Patent Number: 5,651,683

[45] Date of Patent: Jul. 29, 1997

[54] STRUCTURE FOR CONNECTOR ARRANGEMENT FOR VEHICLES

[75] Inventors: Yuzo Shimamura; Tetsuya Fujita; Hiroyuki Ohsuga; Shigeru Oyamada; Mayumi Suzuki; Wataru Taniguchi, all of Omiya, Japan

[73] Assignee: Kansei Corporation, Omiya, Japan

[21] Appl. No.: 470,600

[22] Filed: Jun. 6, 1995

[30] Foreign Application Priority Data

Jun. 6, 1994 [JP] Japan ..... 6-123372

[51] Int. Cl.[6] ..... H01R 33/00

[52] U.S. Cl. ..... 439/34; 439/248; 296/208; 280/779; 174/72 A

[58] Field of Search ..... 439/34, 247, 248; 174/72 A, 68.1; 296/208; 280/779

[56] References Cited

U.S. PATENT DOCUMENTS

| | | | |
|---|---|---|---|
| 3,761,603 | 9/1973 | Hayes et al. | 174/72 A |
| 4,815,984 | 3/1989 | Sugiyama | 439/34 |
| 4,942,499 | 7/1990 | Shibata et al. | 439/247 |
| 4,978,313 | 12/1990 | Kamayama et al. | 439/248 |
| 5,353,190 | 10/1994 | Nakayama et al. | 439/34 |
| 5,549,344 | 8/1996 | Nishijima et al. | 439/34 |

FOREIGN PATENT DOCUMENTS

| | | | |
|---|---|---|---|
| 3-226978 | 10/1991 | Japan . | |
| 5-55988 | 8/1993 | Japan . | |
| 1343481 | 10/1987 | U.S.S.R. | 439/247 |

*Primary Examiner*—Neil Abrams
*Assistant Examiner*—T. C. Patel
*Attorney, Agent, or Firm*—Jacobson, Price, Holman & Stern, PLLC

[57] ABSTRACT

A structure of a connector arrangement for vehicles has a male and a female connector (3, 5, 10, 11) one (10, 11) of which is attached to a vehicle body and the other (3, 5) is wired within an instrument panel, and fixing bolts (16, 17) for regularly fitting the male and female connectors to each other. The connector (10, 11) is upwardly and downwardly, rightwardly and leftwardly displaceably supported a fixed frame (24*e*) as a bracket disposed on a steering member (24) through a floating case (25), etc. The connector (3, 5) is mounted in position where the connector (3, 5) can be temporarily fitted into the connector (10, 11) attached to the vehicle body, at the time the steering member (24) is mounted on a vehicle body panel (7).

8 Claims, 22 Drawing Sheets

STRUCTURE FOR CONNECTOR ARRANGEMENT FOR VEHICLES

BACKGROUND OF THE INVENTION

1. Field of the Invention

This invention relates to a structure for connecting wire harness, and more particularly to a structure of a connector arrangement for vehicles which is used for connecting the wire harness used for electrical wiring in automotive vehicles.

2. Description of the Prior Art

A typical conventional structure of a connector arrangement for vehicles is illustrated in FIGS. 27 and 28.

In the Figures, reference numeral 7 denotes a side panel of an automobile. A bracket 6 is secured to this side panel 7 by fixture screws 8, 8. A couple of female connectors 3, 5 are disposed within the bracket 6. The female connector 3 is connected to one end of an engine room harness 2. The other end of the engine room harness 2 is connected to a head lamp, a battery (both not shown), etc., through a grommet 21. The grommet 21 is attached to a dash panel.

The other female connector 5 is disposed at one end of a vehicle body harness 4. The other end of the vehicle body harness 4 is connected to a tail lamp and other given electric parts, all not shown, received in a rear parcel.

As shown in FIG. 27, male connectors 12, 13 are connected respectively to bifurcated right ends of a main harness 9. The male connectors 12, 13 are adapted to fit respectively into the female connectors 3, 5.

Owing to the foregoing arrangement, a certain harness element in the main harness 9, as shown in FIG. 27, is connected to the engine room harness 2 and vehicle body harness 4 by means of fitting the male connectors 12, 13 respectively into the female connectors 3, 5.

For connecting the male connectors 12, 13 respectively into the female connectors 3, 5, the male connectors 12, 13 are held conformed to the female connectors 3, 5 so as to be fitted into the female connectors 3, 5 by fixing bolts 16, 17, as shown in FIG. 28.

Since the construction and fitting method of and between the female connectors 3, 5 and the male connectors 12, 13 are substantially the same to those disclosed in Japanese Laid-Open Patent Application No. Hei 3-226978 and Japanese Patent Publication No. Hei 5-55988, detailed description thereof is omitted.

In FIG. 27, reference numeral 18 denotes a steering member. Both end portions of the steering member 18 are secured to the vehicle body side panel 7 through a bracket 19. Reference numeral 6 denotes a protective cover attached to the male connectors 12, 13 for protecting the connectors 12, 13.

However, this prior art has the following shortcomings. It is customary that the male connectors 12, 13 are fitted into the female connectors 3, 5 while the automobile is being assembled. Further, the bracket 6 is secured to the neighborhood of the dash panel 20 disposed within the cabin at a lower part thereof. Moreover, as shown in FIG. 27, the fitting operation of the male and female connectors must be performed carefully avoiding the steering member 18 which is laid in the direction of width of the automobile. Accordingly, a person engaging in this work is obliged to keep an awkward attitude during the fitting operation. Therefore, working efficiency is not good.

In addition, the male connectors 12, 13 are held conformed to the female connectors 3, 5 first and thereafter, the fixing bolts 16, 17 are threaded into the female connectors 3, 5 to fit the male connectors 12, 13 into the female connectors 3, 5, respectively. Accordingly, it takes much time and labor to hold the male connectors 12, 13 conformed to the female connectors 3, 5. For this reason, working efficiency is not good, either.

SUMMARY OF THE INVENTION

It is, therefore, an object of the present invention to provide a structure of a connector arrangement for vehicles, in which connectors can be fitted with ease and working efficiency is good.

Another object of the present invention is to provide a structure of a connector arrangement for vehicles, in which wire harness connected to the connectors can be easily wired.

The features of the present invention reside in a structure of a connector arrangement for vehicles comprising a male and a female connector one of which is attached to a vehicle body and the other is attached to one end portion of a wire harness wired within an instrument panel, and regular fitting means for regularly fitting the male and female connectors to each other after the connector attached to one end of the wire harness is temporarily fitted to the connector attached to the vehicle body, the wire harness being wired along a harness wiring member disposed within a main instrument panel, the wire harness including floating means for displaceably supporting the connector attached to one end portion of the wire harness on a bracket disposed on the harness wiring member, the connector attached to the vehicle body being arranged in position on the vehicle body where the connector can be temporarily fitted to the connector attached to one end portion of the wire hardness.

Another feature of the present invention is that the harness wiring member is a steering member.

A further feature of the present invention is that the harness wiring member is a base extending in a direction of width of the vehicle.

A still further feature of the present invention is that the floating means is supported such that the connector attached to one end portion of the wire harness can be displaced upwardly and downwardly, rightwardly and leftwardly, and moved in the fitting direction of the connectors.

A yet further feature of the present invention is that the connector attached to one end portion of the wire harness can be inserted into the bracket in a direction from backward to forward of the vehicle, the connector being formed with an escape-preventive portion for preventing the inserted connector from escaping from the bracket.

DETAILED DESCRIPTION OF THE EMBODIMENTS

Figure 1:
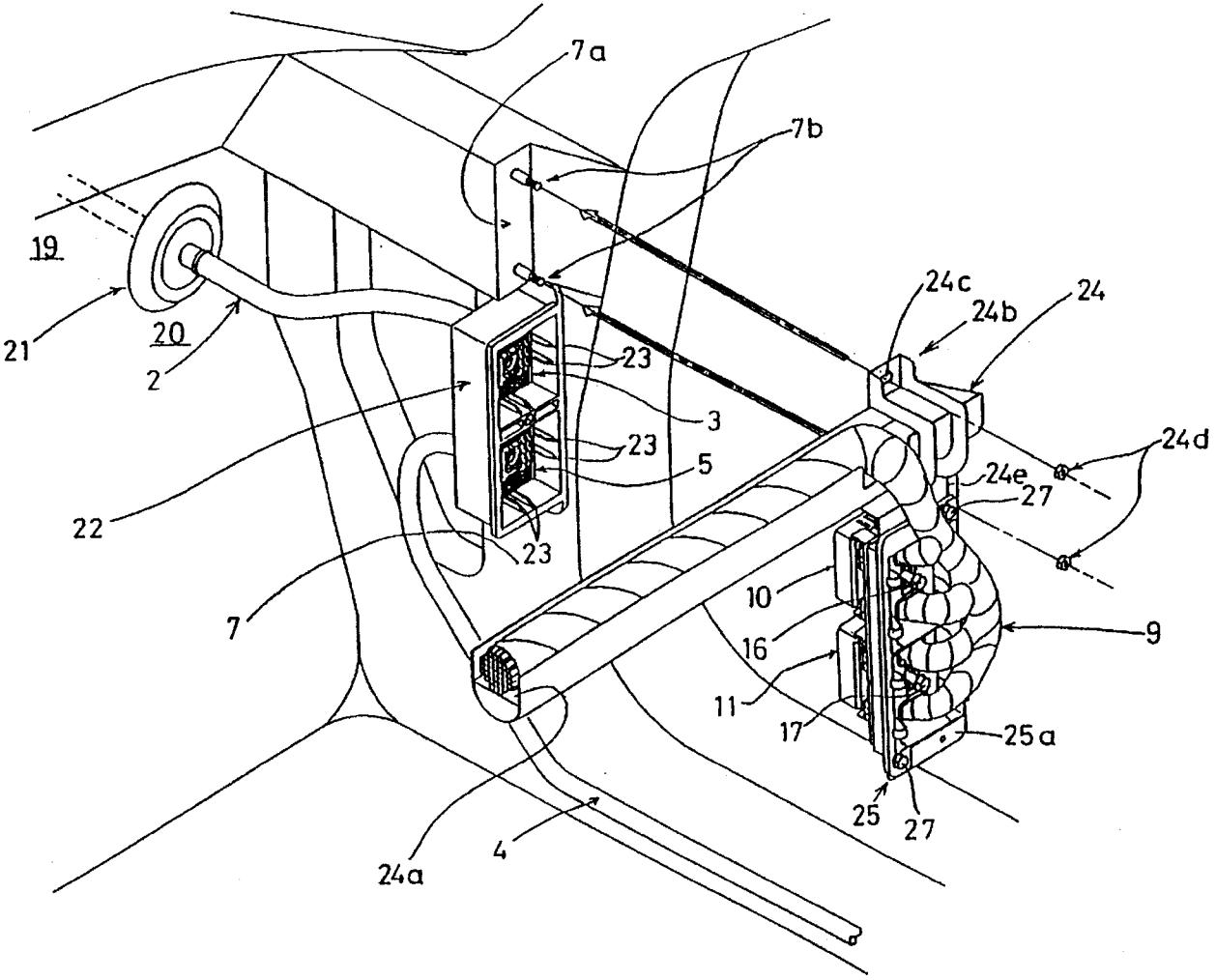
FIG. 1 shows a structure of a connector arrangement for vehicles according to a first embodiment of the present invention and is an overall perspective view for explaining one mode for mounting a steering member.

Several embodiments of the present invention will now be described with reference to the accompanying drawings.

FIGS. 1 to 11 show a first embodiment of the present invention. Similar or identical parts of the prior art are denoted by identical reference numerals.

In the structure of a connector arrangement for vehicles according to the first embodiment of the present invention, an engine room harness 2 extends from an engine room 19 to the inner side of a cabin 20 through a grommet 21.

A female connector 3 is disposed at a distal end of the engine room harness 2. Similarly, a female connector 5 is disposed at a distal end of a vehicle body harness 4. The female connectors 3, 5 are received in a fixed bracket 22. The fixed bracket 22 is secured to a vehicle body side panel 7 by fixture screws 8, 8 as shown in FIG. 3.

Figure 8:
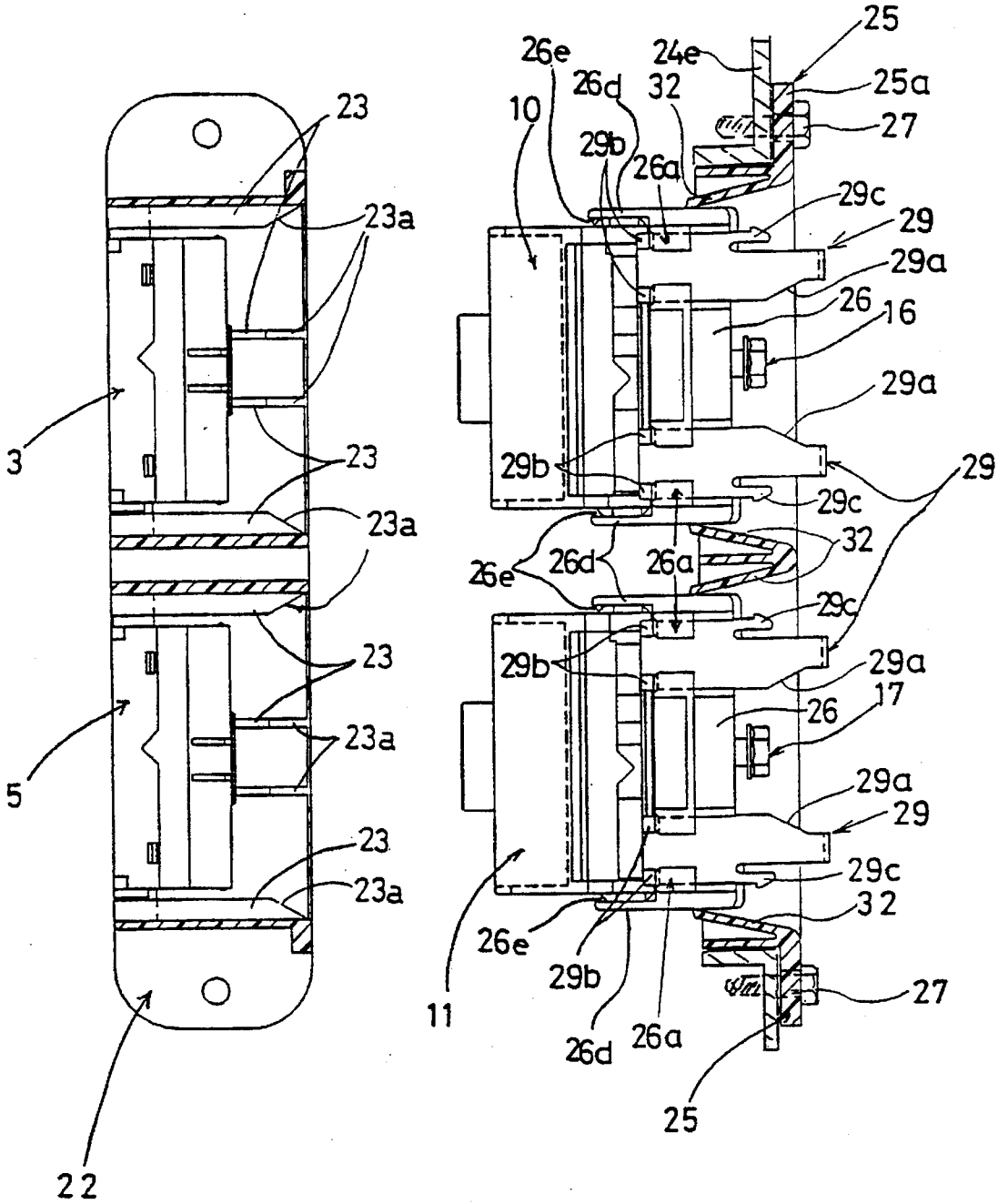
FIG. 8 shows the structure of a connector arrangement for vehicles according to the first embodiment of the present invention and is a sectional view.

As shown in FIG. 8, the female connector 3 is fixedly received in an upper portion of the fixed bracket 22, and the female connector 5 is fixedly received in a lower portion of the fixed bracket 22. Since the construction of the lower portion, in which the female connector 5 is fixedly received, is generally the same to that of the upper portion, in which the female connector 3 is fixedly received, like parts are denoted by like reference numerals and description thereof is omitted.

Figure 5:
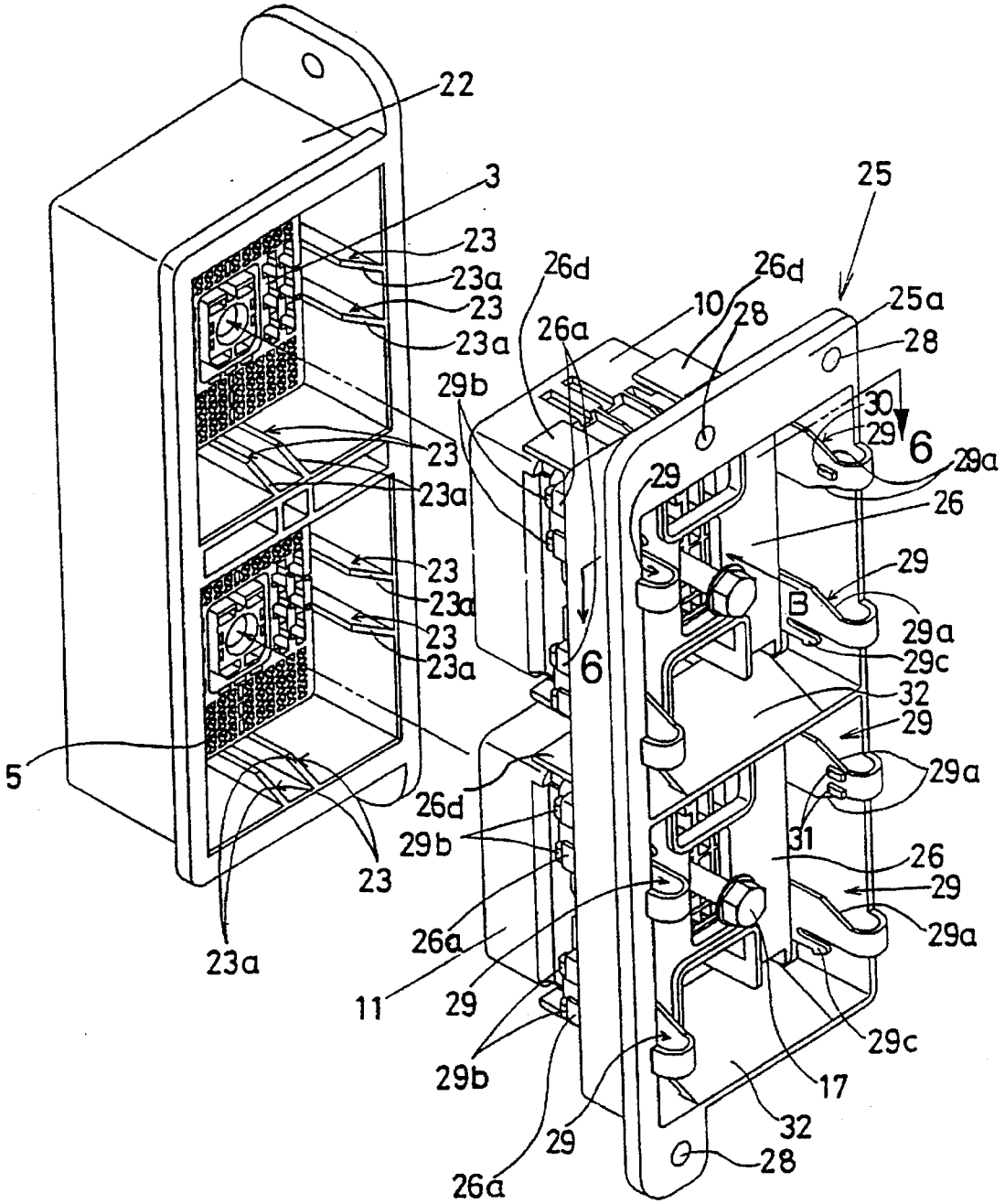
FIG. 5 is an exploded perspective view showing the structure of a connector arrangement for vehicles according to the first embodiment of the present invention.

As shown in FIG. 5, a pair of guide projections 23 are spacedly formed on each vertical and each horizontal inner side wall. More specifically, the guide projections 23 vertically spacedly formed on one vertical inner side wall, together with those formed on their opposite vertical inner side wall, constitute two pairs of guide projections 23. Similarly, the guide projections 23 horizontally spacedly formed on one horizontal inner side wall, together with those formed on their opposite horizontal inner side wall, constitute two pairs of guide projections 23. The guide projections 23 extend in the fitting directions of the male connector 12. Each guide projection 23 is provided on a fitting side of the female connector 3 with a tapered portion 23*a*. When the male connector 10 is temporarily fitted into the female connector 3 as later described, the male connector 10 is guided along the tapered portion 23*a* and faced at a straight portion 23*b* thereof with an opening portion of the male connector 10.

Figure 3:
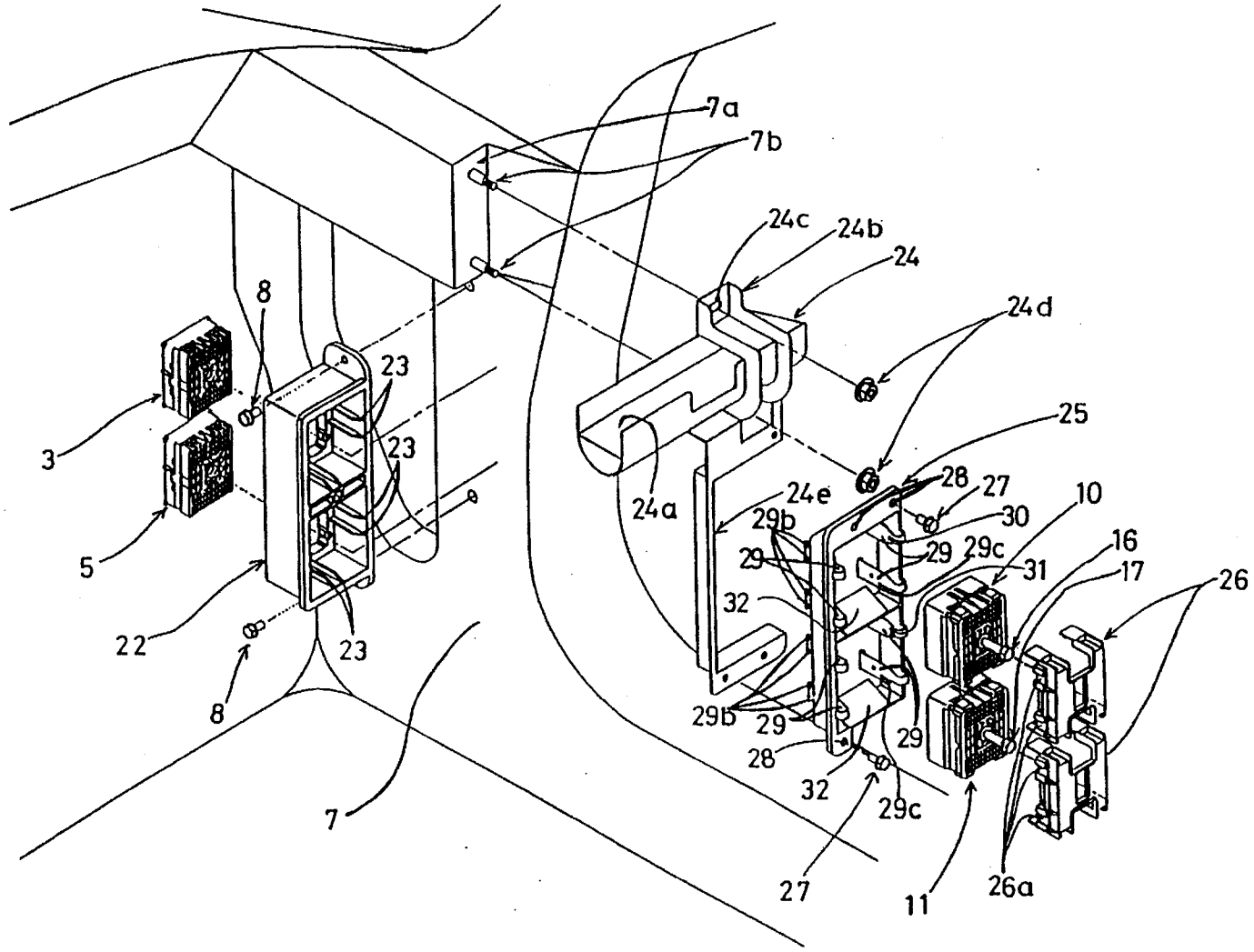
FIG. 3 is an exploded perspective view showing the structure of a connector arrangement for vehicles according to the first embodiment of the present invention.

As shown in FIG. 3, on the vehicle body side panels 7 provided on right and left sides, attaching portions 7*a* (in FIG. 3, the attaching portion 7*a* formed on the left vehicle body side panel 7 is omitted) of the steering member 24 are formed. The attaching portions 7*a* are provided with locate bolts 7*b*, 7*b*, respectively. The locate bolts 7*b*, 7*b* project backwardly of the automobile.

Figure 2:
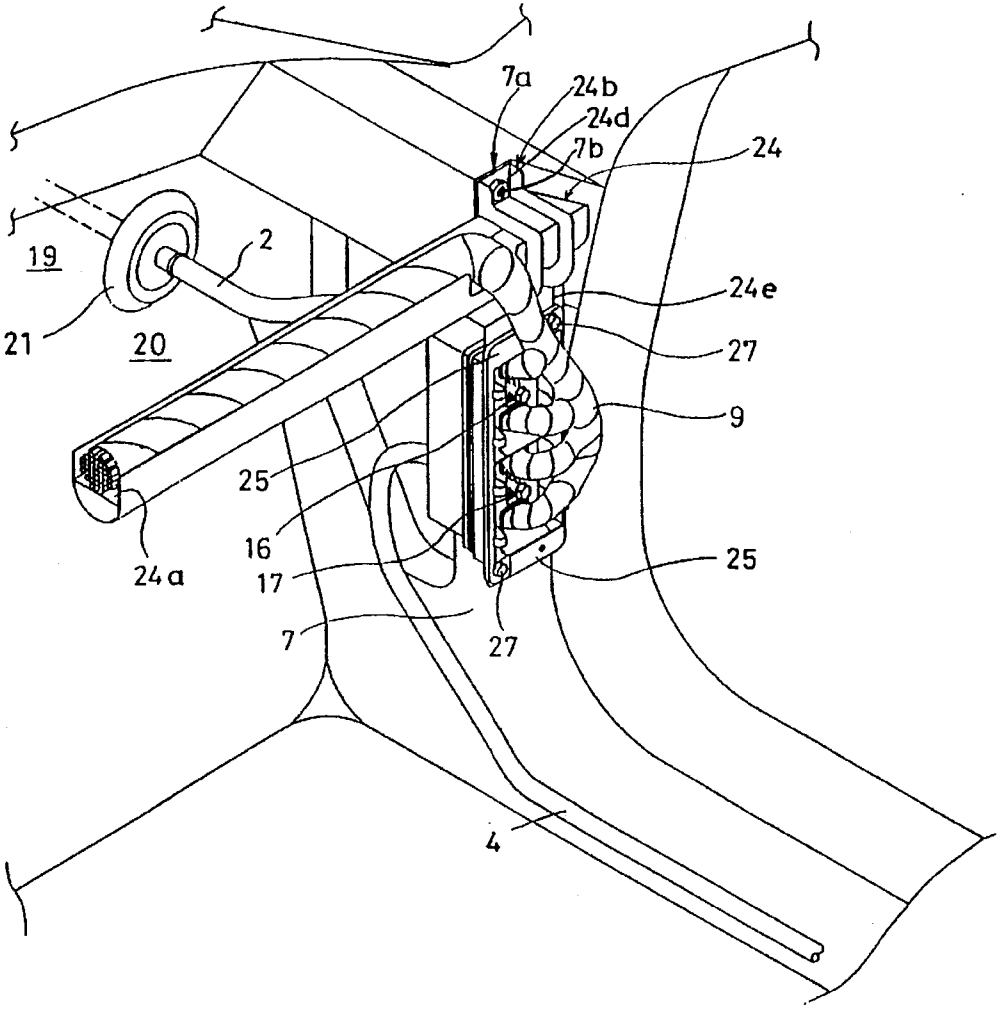
FIG. 2 is a perspective view showing the structure of a connector arrangement for vehicles according to the first embodiment of the present invention, but showing a state after the steering member has been mounted.

The steering member 24, whose opposite end portions are attached respectively to the attaching portions 7*a*, 7*a*, is provided, as shown in FIG. 3, with vehicle body attaching elements 24*b* which are firmly secured to opposite end portions of the steering member 24 (in FIG. 3, the vehicle body attaching element 24*b* firmly secured to the left end portion of the steering member 24 is omitted). Owing to this arrangement, by inserting the locate bolts 7*b*, 7*b* respectively into attaching holes 24*c*, 24*c* formed in the vehicle body attaching elements 24 and tightening respectively with nuts 24*d*, 24*d*, the opposite end portions of the steering member 24 are mounted on the attaching portions 7*a* of the vehicle body side panels 7, as shown in FIG. 2.

As shown in FIG. 3, the fixed frame 24*e* serving as a bracket is fixedly welded to a lower surface of the right end portion of the steering member 24. The bracket is allowed to extend toward a lower part of the steering member 24. A floating case 25 is attached to the fixed frame 24*e* by inserting machine screws 27 into attaching holes 28 formed in a peripheral portion 25*a* of the floating case 25 and screwing the machine screws 27 tight to the fixed frame 24*e*. The floating case 25 serves as a floating means in which the male connectors 10, 11 are disposed.

Figure 4:
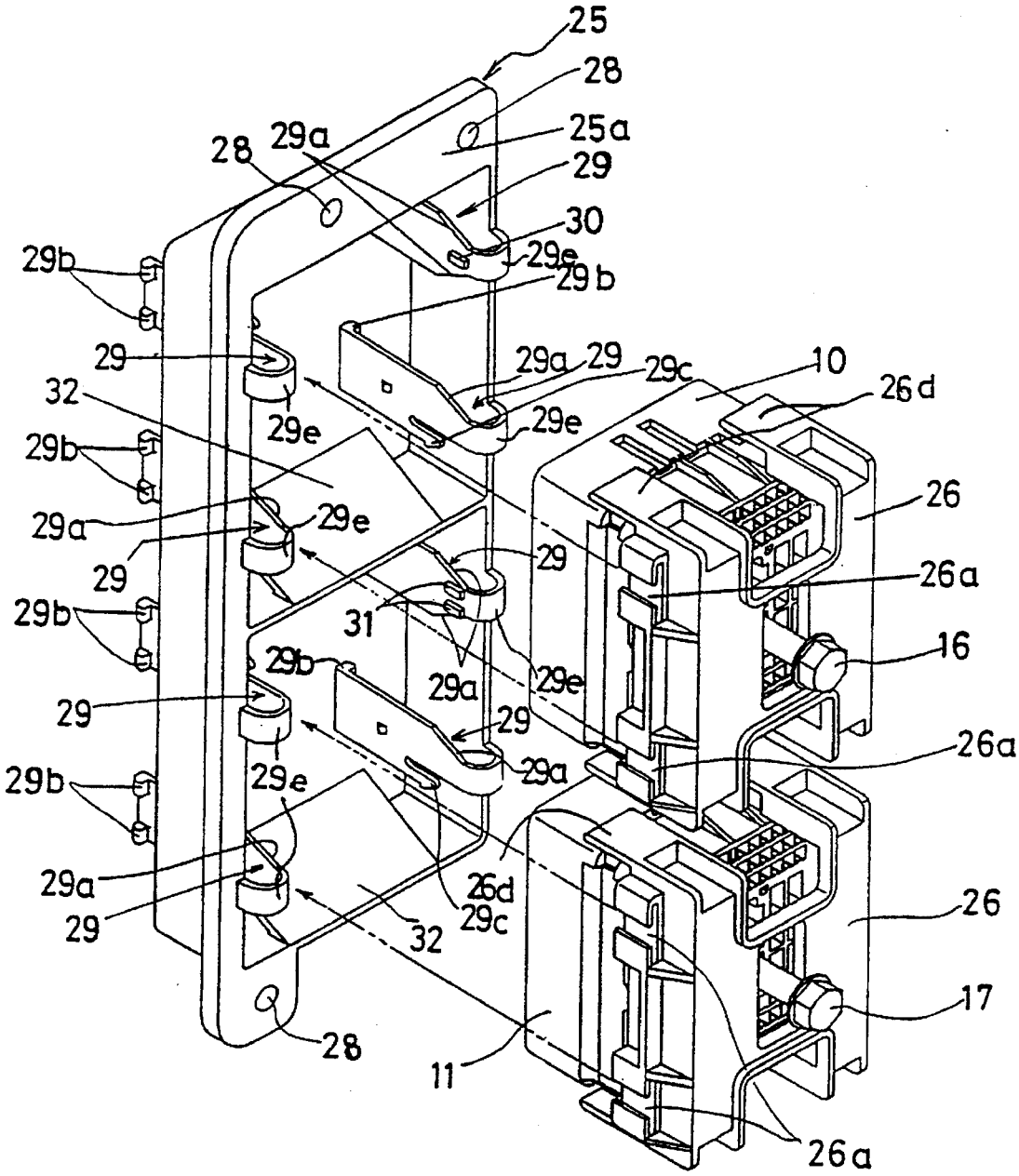
FIG. 4 is an exploded perspective view showing the structure of a connector arrangement for vehicles according to the first embodiment of the present invention.

As shown in FIG. 4, the male connector 10 is mounted in an upper portion of the floating case 25, whereas the male connector 11 is mounted in a lower portion of the floating case 25, such that the male connectors 10, 11 can not only be displaced upwardly and downwardly, rightwardly and leftwardly with respect to the fitting direction but also be moved forwardly and backwardly in the fitting direction. Since the construction of the lower portion in which the male connector 11 is mounted is generally the same to that of the upper portion in which the male connector 10 is mounted, like parts are denoted by like reference numerals and description thereof is omitted. Only different parts will be described.

As shown in FIG. 3, two pairs of slide arms 29 are vertically spacedly formed respectively on right and left inner walls of the floating case 25. Each slide arm 29 is curved inwardly, with its distal end extending forwardly and backwardly of the automobile, i.e., toward the female connector 3.

As shown in FIG. 4, each slide arm 29 has a tapered portion 29*a*. Owing to provision of this tapered portion 29*a*, a basal end side of each slide arm 29 is defined as a weak portion 29*e* which is weaker than the distal end side.

Because of the feature of this weak portion 29*e*, the distal end portion situated forwardly of the tapered portion 29*a* can be displaced upwardly and downwardly, rightwardly and leftwardly with respect to the fitting direction.

Figure 6:
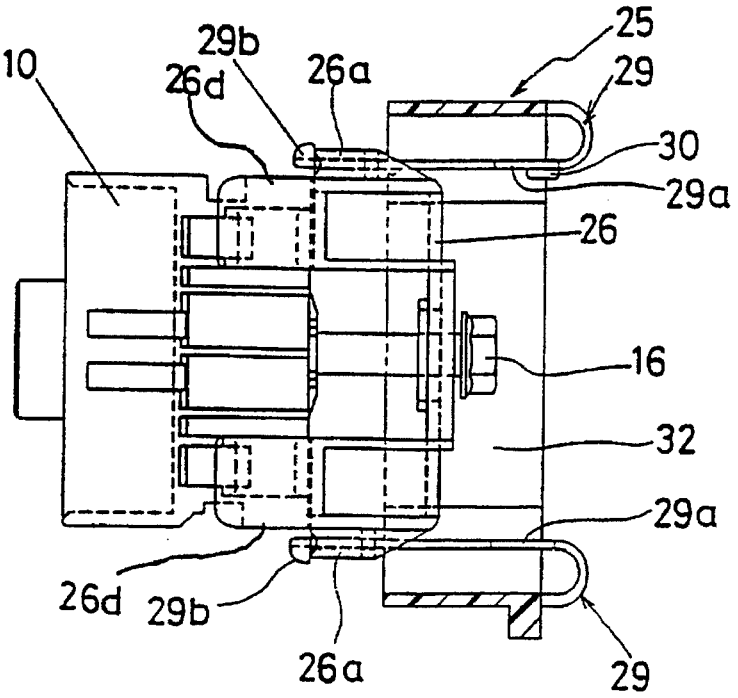
FIG. 6 shows the structure of a connector arrangement for vehicles according to the first embodiment of the present invention and is a sectional view taken on line A—A of FIG. 5.
Figure 7:
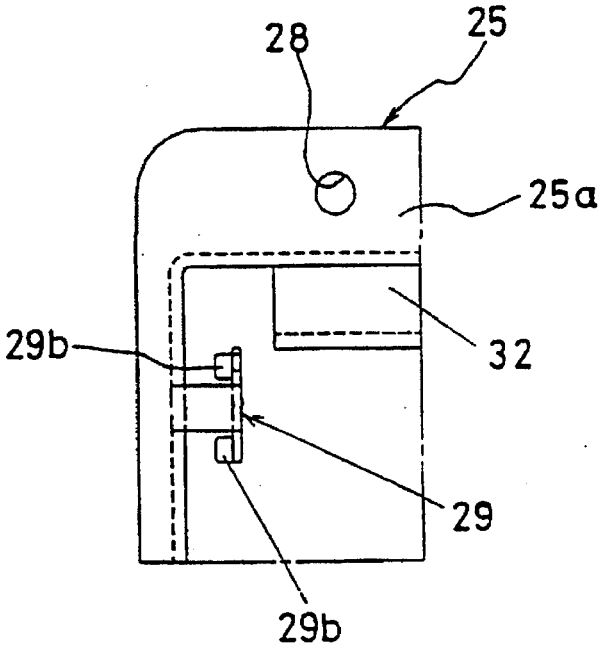
FIG. 7 shows the structure of a connector arrangement for vehicles according to the first embodiment of the present invention and is a partly front view when viewed in a direction as indicated by an arrow B of FIG. 5.

As shown in FIGS. 4 and 6, two pairs of slide grooves 26*a* are formed on each connector cover 26. By inserting the slide arms 29 respectively into the slide grooves 26*a*, each connector cover 26 is movably attached to the slide arms 29 for movement in the extending direction of the slide arms 29.

As shown in FIGS. 6 and 8, the connector cover 26 is provided at upper and lower walls thereof with four elastic tongue pieces 26*d*. An engaging claw 26*e* is formed on an inner side of a distal end portion of each elastic tongue piece 26*d*. By causing the engaging claws 26*e* to engage the male connector 10, the male connector 10 is attached to the connector cover Accordingly, by being attached to the slide arms 29 through the connector cover 26, the male connector 10 is mounted within the floating case 25 for displacement upwardly and downwardly, rightwardly and leftwardly with respect to the fitting direction and for movement forwardly and backwardly in the fitting direction.

In the Figures, reference numeral 29*b* denotes a forward escape-preventive stopper formed on a foremost edge of each slide arm 29. This escape-preventive stopper 29*b* is adapted to prevent the male connector 10 from escaping from the distal end of the slide arm 29.

Similarly, reference numeral 29*c* denotes a rearward escape-preventive stopper. This rearward escape-preventive stopper 29*c* is adapted to prevent the male connector 10 from escaping from the distal end of the slide arm 29. When the male connector 10 is attached to the slide arm 29, the rearward escape-preventive stopper 29*c* is displaced at its distal end toward the slide arm 29 in order to facilitate the attachment of the male connector 10. Also, the distal end portion of the escape-preventive slide arm 29 is engaged with the retreating male connector 10 in order to prevent the male connector 10 from escaping rearwardly.

The engagement of the male connector 10 can be removed by displacing the distal end of the rearward escape-preventive stopper 29*c* toward the slide arm 29. By doing this, the male connector 10 can be separated away from the slide arm 29.

As shown in FIG. 8, elastic restraining pieces 32, 32 are formed on upper and lower opposite inner walls of the floating case 25. The elastic restraining pieces 32, 32 extend toward each other as they go from the inserting edge of the male connector 10 toward the female connector 3. Distal ends of the elastic restraining pieces 32 are normally in engagement with upper and lower surfaces of the male connector 10, thereby retaining the male connector 10.

With respect to the retaining ability of the elastic retaining pieces 32, 32, the retaining pieces 32, 82 are designed such that they have such degree of retaining force as not to restrain the twisting of the weak portion 29e of the slide arm 29, particularly the upward and downward twisting of the weak portion 29*e*. Also, the elastic retaining pieces 32, 32 prohibit the male connector 10 from greatly displacing upwardly and downwardly, thereby preventing the weak portion 29*e* from being damaged.

A wiring groove 24*a* is formed in the steering member 24. The wiring groove 24*a* has a generally U-shaped configuration opening upwardly. A main harness 9 as one of the wire harness is disposed in the wiring groove 24*a* in such a manner as to extend along the steering member 24.

One end of this wire harness 9 is branched into a plurality of parts which are provided with the male connectors 10, 11 as shown in FIG. 3, which connectors 10, 11 are connected to the female connectors 3, 5.

Furthermore, the slide arm 29 is formed with erroneous-combination preventive-projections 30, 81. The projection 30 is formed of a single projection in order to conform to the male connector 10, whereas the other projection 31 is formed of two projections in order to conform to the male connector 11.

Next, operation of the first embodiment will be described.

Figure 9:
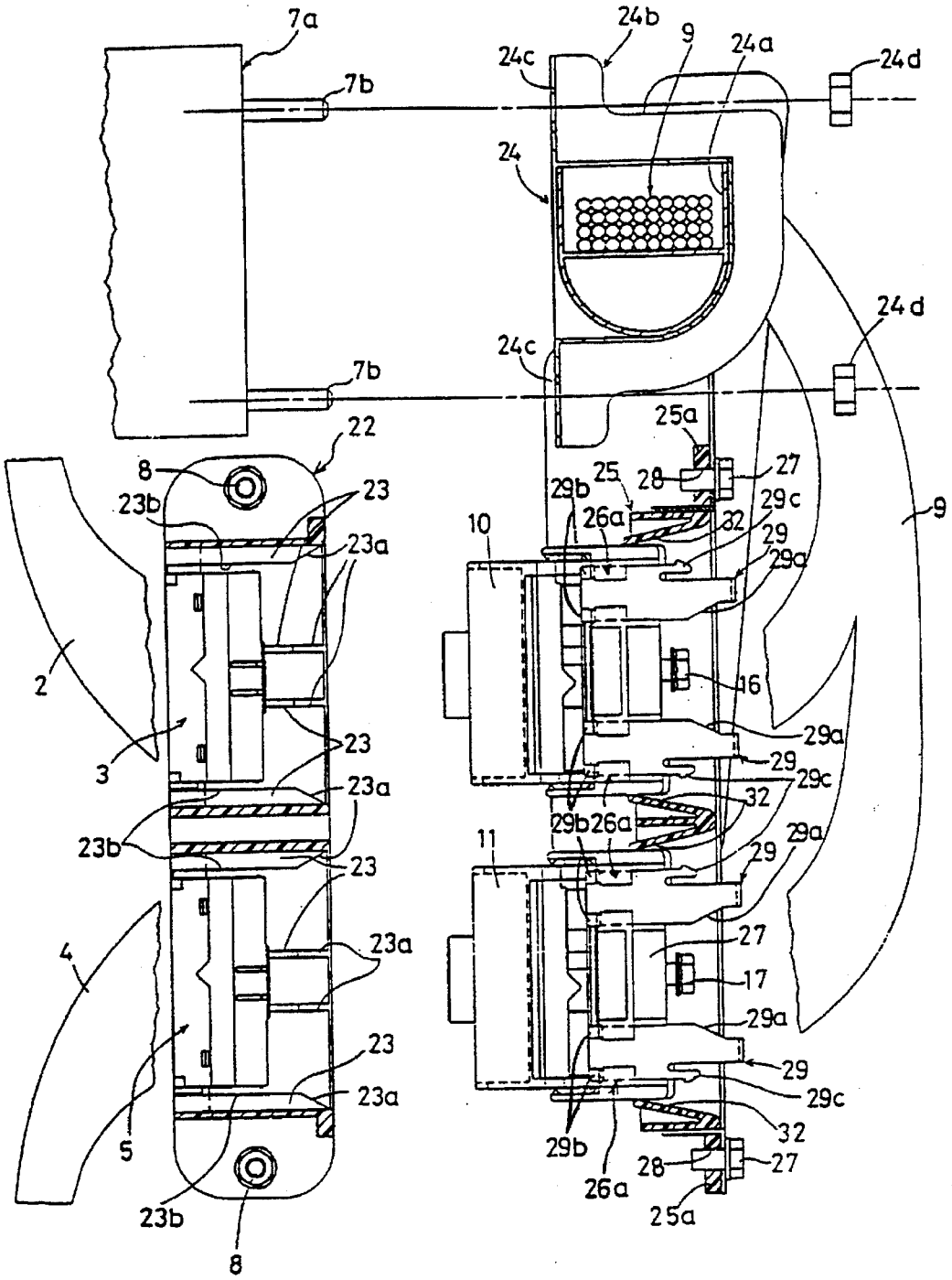
FIG. 9 shows the structure of a connector arrangement for vehicles according to the first embodiment of the present invention and is a partly sectional view for explaining one mode before the steering member is mounted.
Figure 10:
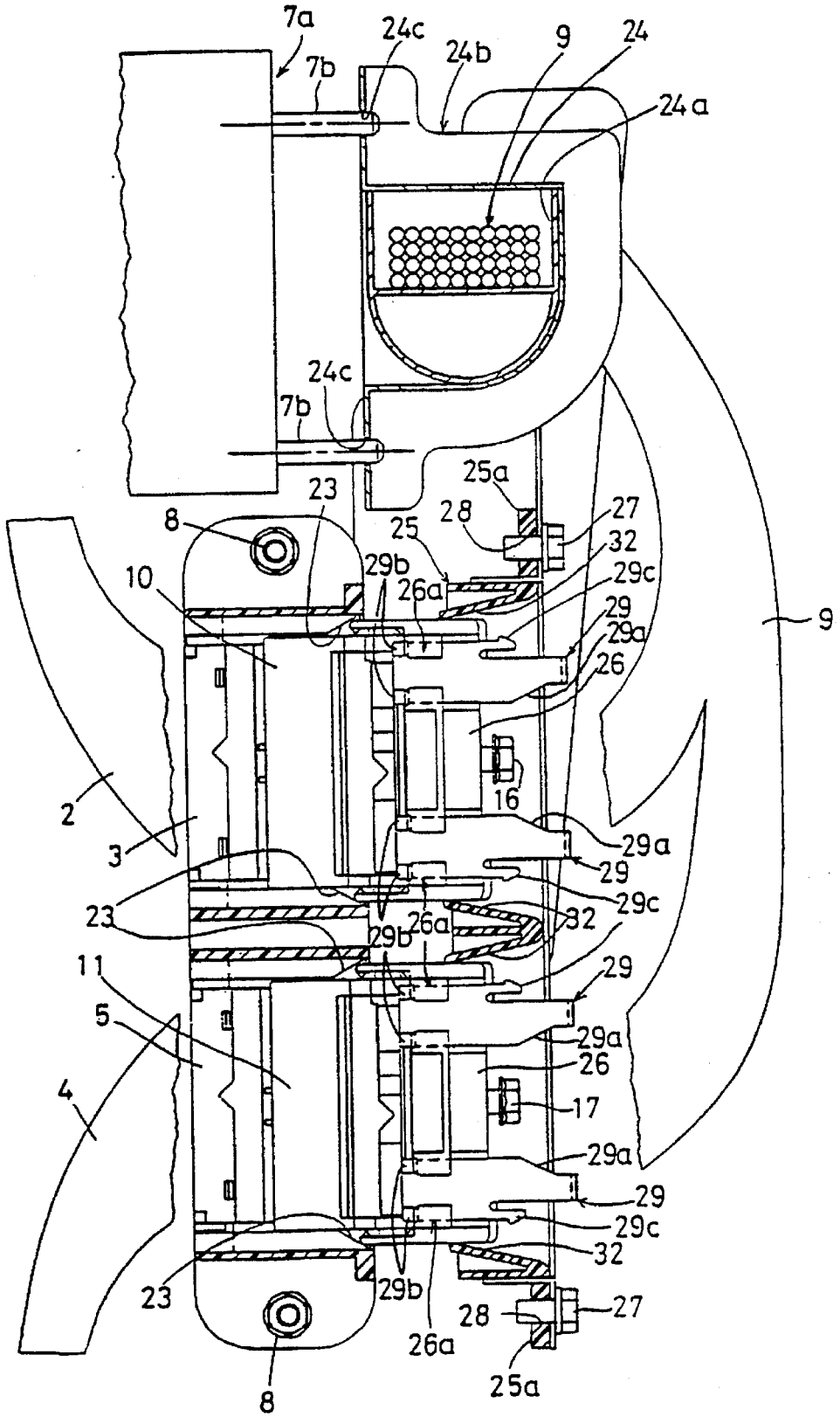
FIG. 10 shows the structure of a connector arrangement for vehicles according to the first embodiment of the present invention and is a partly sectional view for explaining one mode for mounting the steering member.

As shown in FIG. 4 or 9, the male brackets 10, 11 are inserted into the floating case 25 from backward to forward of the automobile. When the slide arms 29 are inserted into the slide grooves 26*a* formed in the connector covers 26 which are provided beforehand on the male brackets 10, 11, they are introduced into predetermined floating position guided by the tapered portions 29*a* of the slide arms 29. At that time, the rearward escape-preventive stopper 29*c* is elastically deformed by abutment, thereby permitting insertion. Owing to provision of the erroneous combination preventive-projections 30, 31, the male connectors 10, 11 are prevented from being inserted in an opposite way.

As shown in FIGS. 5 and 6, when the periphery of the slide grooves 26*a* is inserted into position for abutting with the forward escape-preventive stopper 29*b*, the brackets 10, 11 are limited in upward and downward movements to a predetermined amount by the elastic restraining pieces 32, 32. With respect to the rightward and leftward directions, the male connectors 10, 11 are elastically supported by the slide arms 29, thereby realizing a leftwardly and rightwardly displaceable so-called floating state. At this time, the male connectors 10, 11 are prevented from escaping backwardly of the automobile by the rearward escape-preventive stopper 29*c*.

Since the male connectors 10, 11 can be inserted into the floating case 25 from backward to forward of the automobile, the sequential steps of assembly can be more freely selected.

For this reason, it becomes possible, for example, that the floating case 25 is secured to the fixed frame 24*e* of the steering member 24, the male connectors 10, 11 are arranged beforehand at the terminal of the main harness 9, and thereafter, the male connectors 10, 11 can be inserted into the floating case 25. Therefore, attaching workability is good.

Next, as shown in FIG. 1, the main harness 9 is wired in the wiring groove 24*a* of the steering member 24 along the steering member 24, and then, the floating case 25 supporting the male connectors 10, 11 in a floating state is secured to the fixed frame 24*e* by the machine screws 27, thereby realizing a so-called sub-assembly state of the steering member 24. This sub-assembly state of the steering member 24 is then secured to the automobile body.

At that time, when the steering member 24 is assembled from backward to forward of the automobile as indicated by void arrows of FIG. 1, the two locate bolts 7*b*, 7*b* guide the male connectors 10, 11 to the position where the fixed bracket 22 is arranged, so that the male connectors 10, 11 are temporarily fitted into the bracket In this temporarily fitting state, the tapered portions 23*a* of the guide projections 23 guide the inserted male connectors 10, 11 up to the female connectors 3, 5 in the fixed bracket 22. Since the male connectors 10, 11 are prevented from slide-escaping backwardly of the automobile by the rearward escape-preventive stoppers 29*c*, reliability is high. Further, since the worker may pay attention only to the arrangement of the steering member workability is good also in this respect.

Since the male connectors 10, 11 are upwardly and downwardly, forwardly and backwardly displaceably supported by the weak portions 29*c* of the slide arms 29 of the floating case 25, the male connectors 10, 11 can be moved up to the position where the slide arms 29 can correctly fit, in the fitting direction of the connectors, while appropriately correcting positional displacement, if any. As a consequence, the connectors can be reliably interconnected by means of a regular fitting operation.

Figure 11:
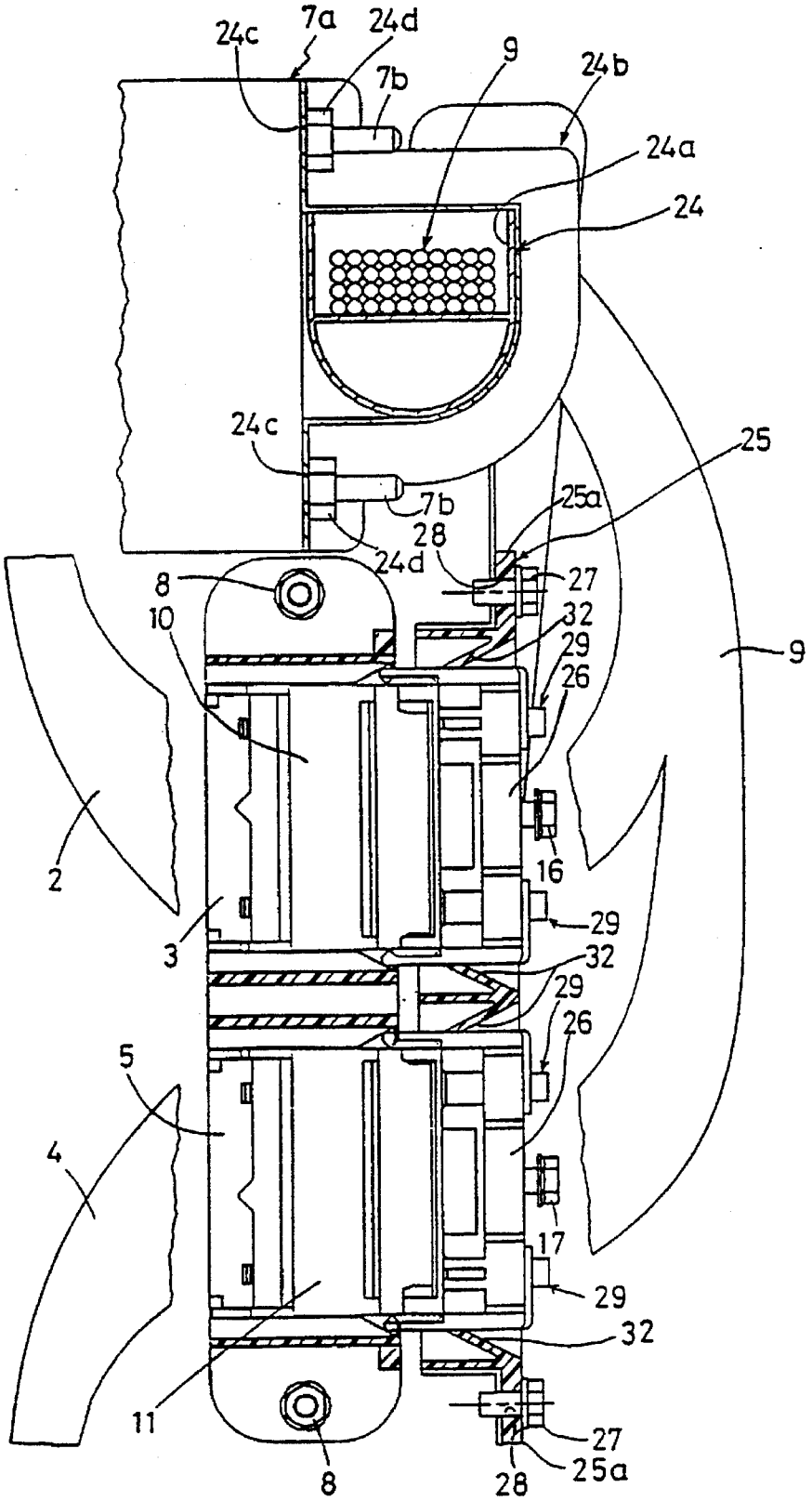
FIG. 11 shows the structure of a connector arrangement for vehicles according to the first embodiment of the present invention and is a partly sectional view for explaining one mode after the steering member has been mounted.
Figure 12:
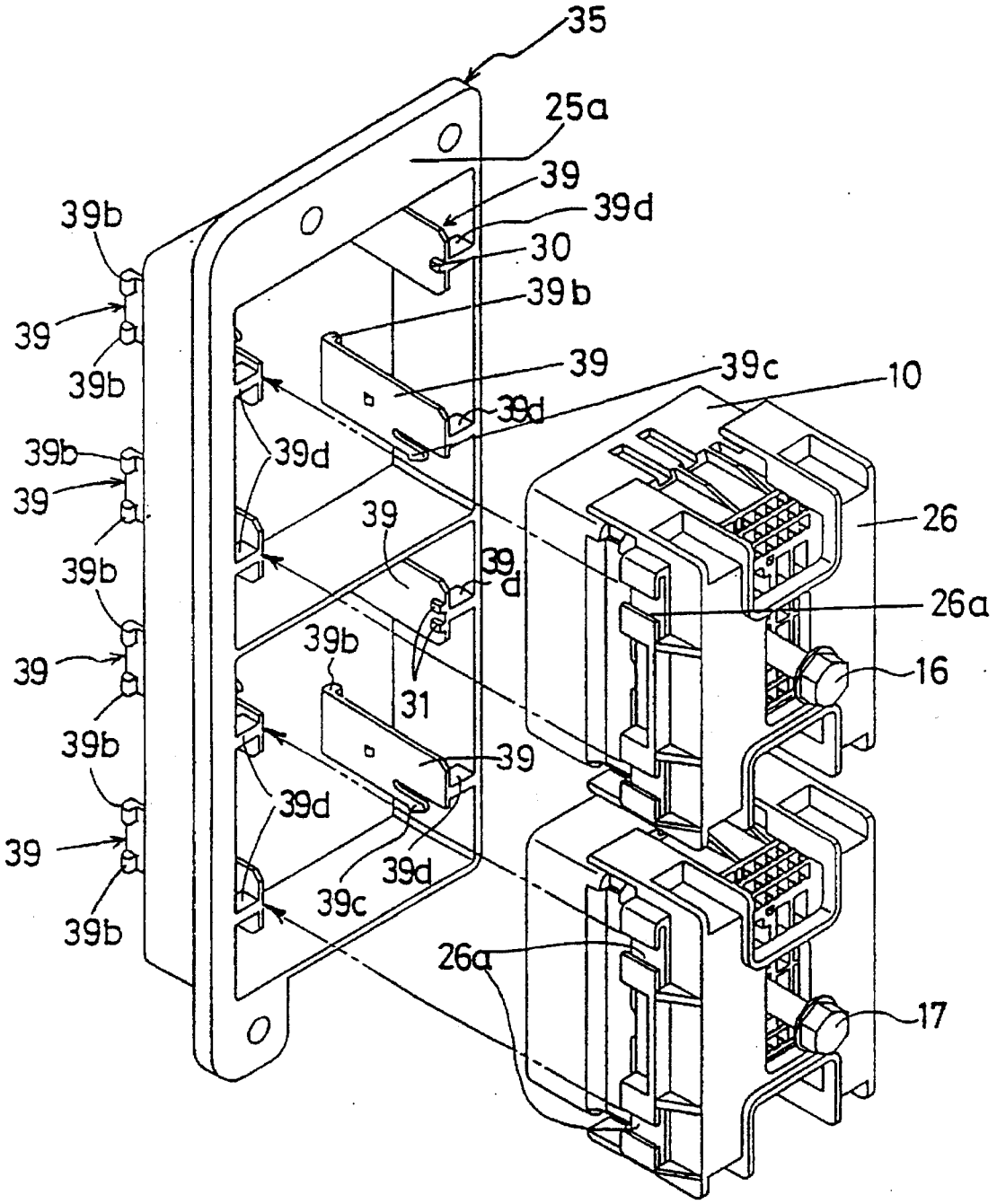
FIG. 12 is a perspective view showing the structure of a connector arrangement for vehicles according to a second embodiment of the present invention.
Figure 13:
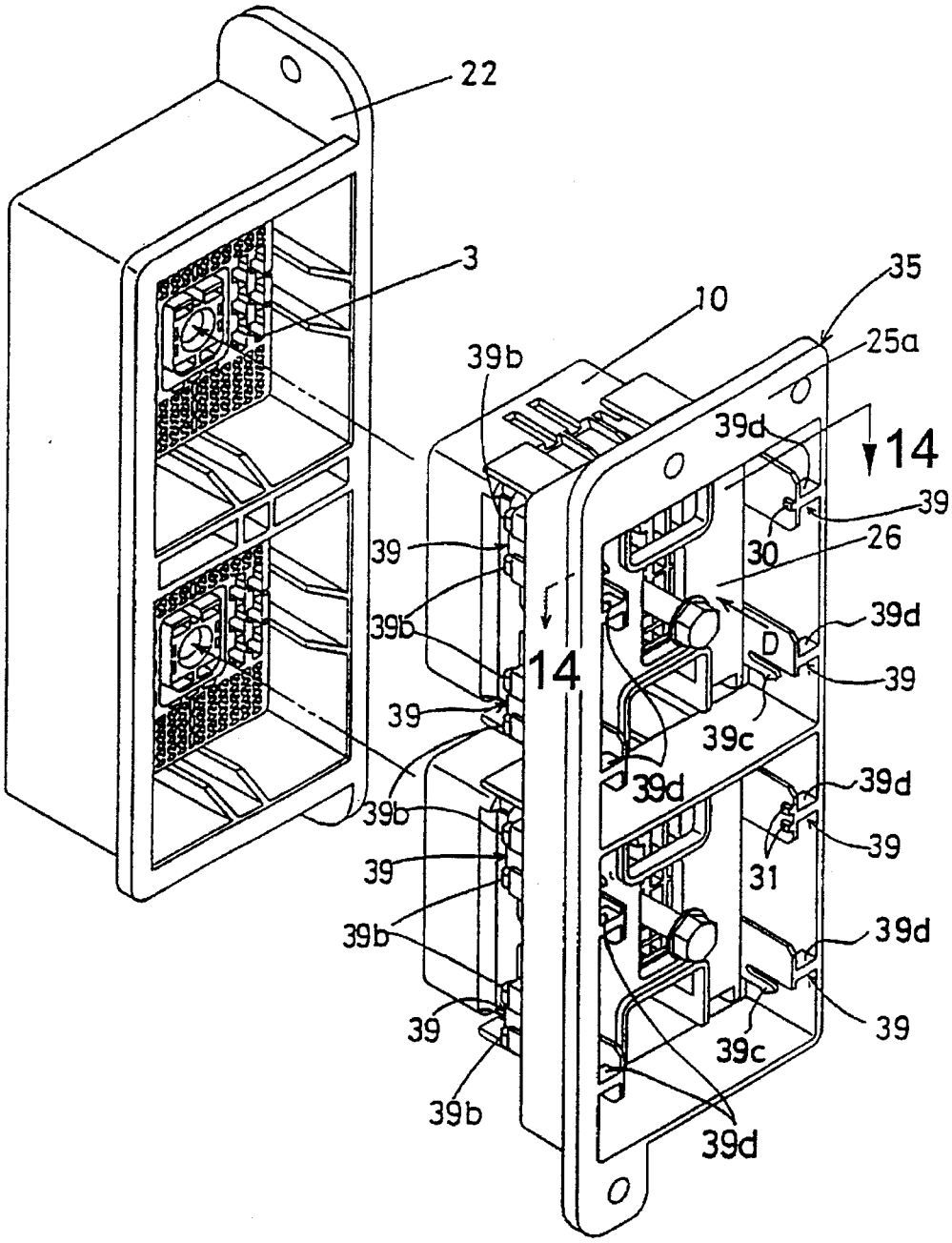
FIG. 13 is a perspective view showing the structure of a connector arrangement for vehicles according to the second embodiment of the present invention.
Figure 14:
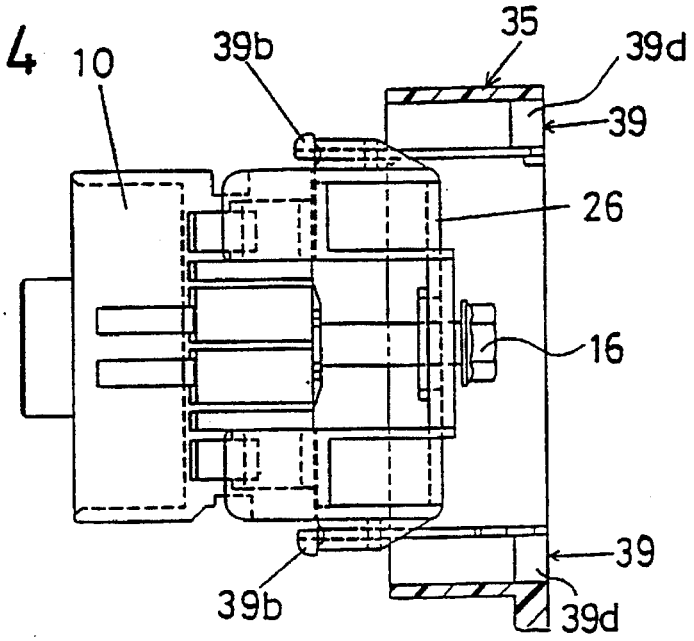
FIG. 14 shows the structure of a connector arrangement for vehicles according to the second embodiment of the present invention and is a sectional view taken on line C—C of FIG. 13.
Figure 15:
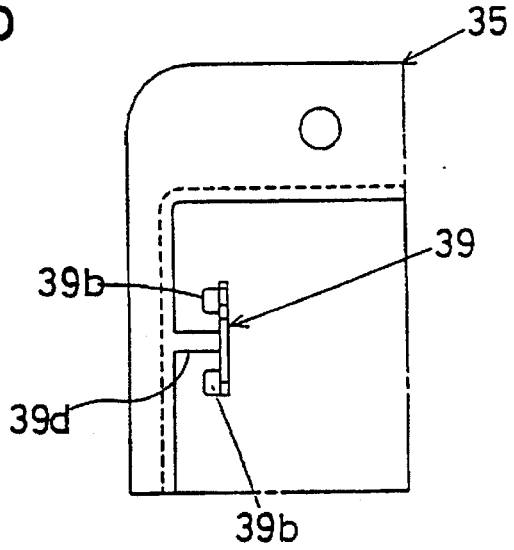
FIG. 15 shows the structure of a connector arrangement for vehicles according to the second embodiment of the present invention and is a partly front view when viewed in a direction as indicated by an arrow D.

More specifically, as shown in FIG. 11, the vehicle body attaching portion 24*b* of the steering member 24 is secured to the steering member attaching portion 7*a* by screwing the nuts 24*d* with respect to the locate bolts 7*b*, 7*b*.

Then, the fixing bolts 16, 17 serving as the regular fitting means are tightened from above the connector covers 26, 26, so that the female connectors 3, 5 are regularly fitted to the male connectors 10, 11, respectively. Since the female connectors 3, 5 and the male connectors 10, 11 are correctly positioned, the fixing bolts 16, 17 can be easily threadedly engaged with the female connectors 3, 5 so that the main harness 9 is electrically connected to the engine room harness 2 and body harness 4.

Further, since the main harness 9 is wired along the steering member 24, the main harness 9 is not interfered with other members during the attaching operation of the steering member 24. As a consequence, assembling operation can be performed smoothly. Moreover, the wiring operation of the main harness 9 is substantially completed by the attachment of the steering member 24 to the vehicle body, and the assembling work can be performed more smoothly. For this reason, the number of processes for forcing the worker to take, for example, a somewhat awkward attitude as often experienced in the prior art, can be reduced and therefore, attaching workability is good.

FIGS. 12 to 15 show a second embodiment of the present invention. Similar or identical parts of the first embodiment are denoted by identical reference numerals, and different parts are mostly described.

In the structure of a connector arrangement for vehicles according to this second embodiment, a plurality of slide arms 39 are formed in right and left inner walls of a floating case 35 through support portions 39*d* as weak portions. Each slide arm 39 has a generally T-shaped configuration in section. Forward escape-preventive stoppers 39*b*, 39*b* are formed on the distal ends of the slide arms 39, respectively. In the Figures, reference numeral 39*c* denotes a rearward escape preventive stopper. This stopper 39*c* is adapted to prevent the male connector 10 from escaping from the distal end of the slide arm 39. When the male connector 10 is attached to the slide arm 39, the rearward escape-preventive stopper 39*c* is deformed at its distal end toward the slide arm 39 in order to facilitate the attachment of the male connector 10. Also the distal end portion of the rearward escape-preventive stopper 39*c* is engaged with the retreating male connector 10, so that the male connector 10 is prevented from escaping rearwardly.

Operation of the second embodiment will now be described.

In the structure of a connector arrangement for vehicles according to the second embodiment, the slide arms 39*d* are supported by the support portions 39 and each formed in a generally T-shaped configuration in section. Accordingly, when inserted into the slide grooves 26*a*, the male connectors 10, 11 can be assembled into the floating case 35 from backward to forward of the automobile. As a consequence, attaching workability is good.

Since the remaining construction and operation are generally the same to those of the first embodiment, description thereof is omitted.

Figure 16:
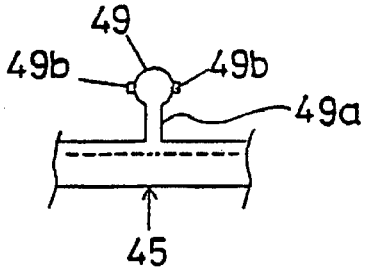
FIG. 16 shows a structure of a connector arrangement for vehicles according to a third embodiment of the present invention and is a partly front view corresponding to the position as indicated by the arrow D.
Figure 17:
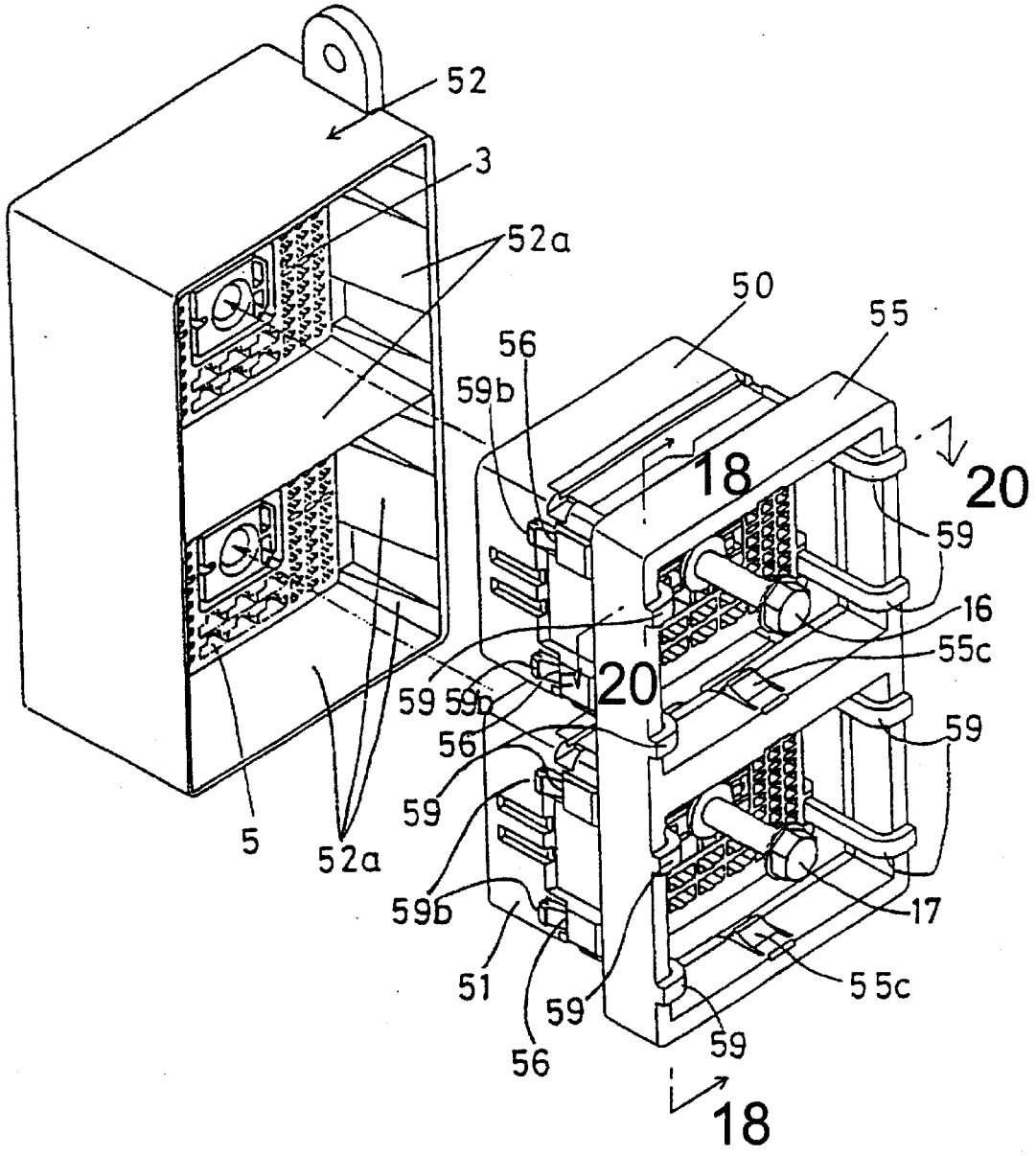
FIG. 17 is a perspective view showing a structure of a connector arrangement for vehicles according to a fourth embodiment of the present invention.
Figure 18:
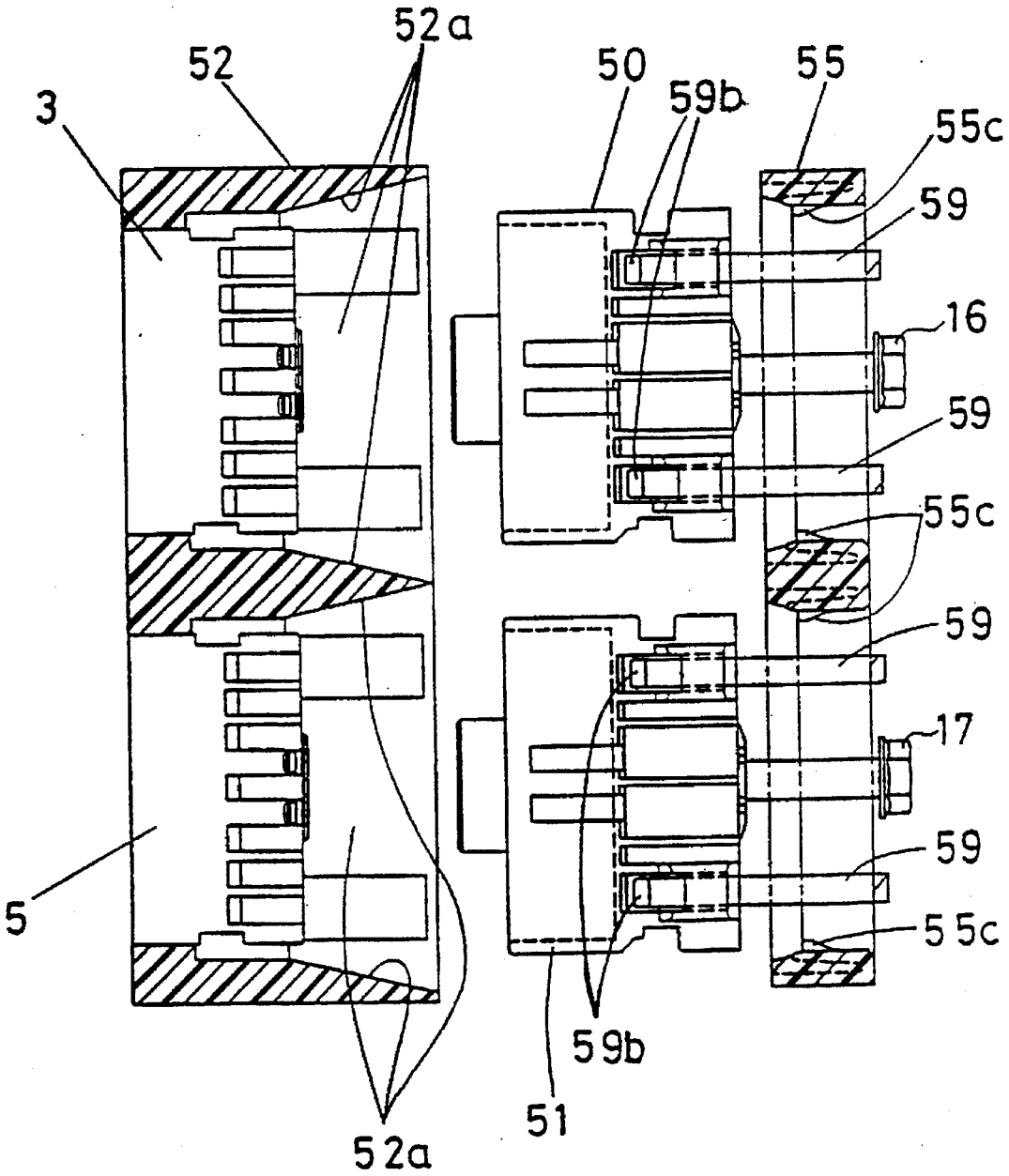
FIG. 18 shows the structure of a connector arrangement for vehicles according to the fourth embodiment of the present invention and is a sectional view taken on line E—E of FIG. 17.
Figure 19:
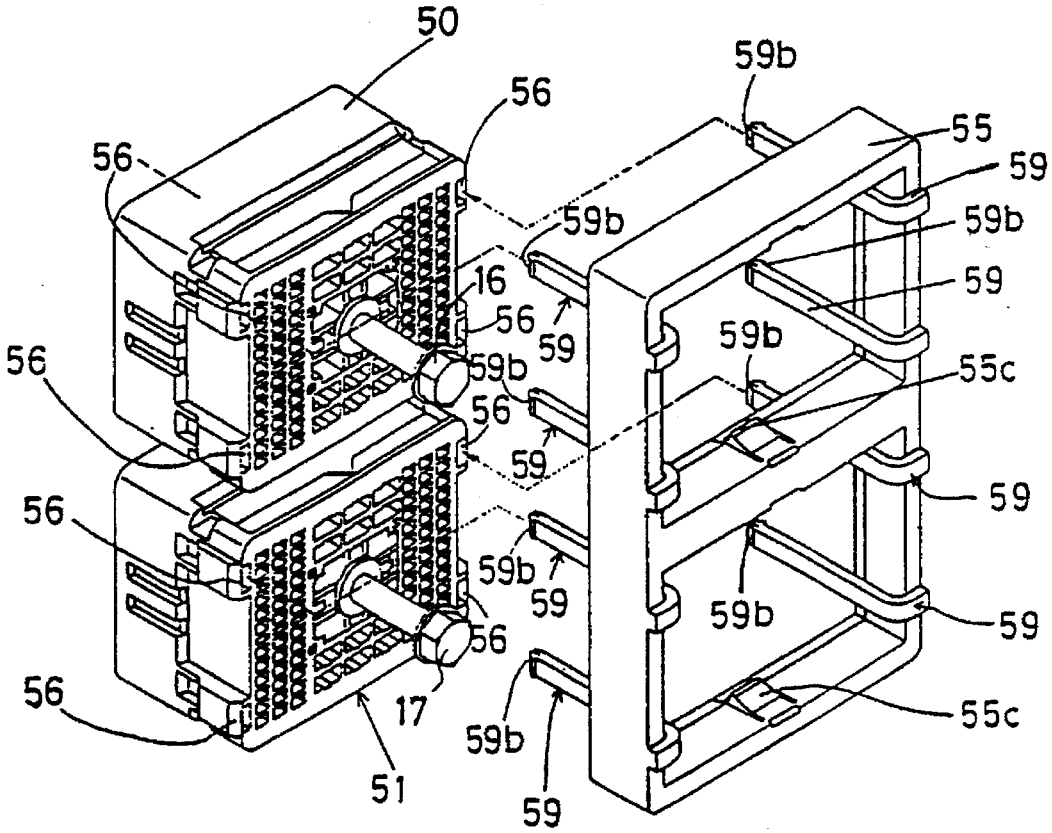
FIG. 19 is a perspective view showing the structure of a connector arrangement for vehicles according to the fourth embodiment of the present invention.
Figure 20:
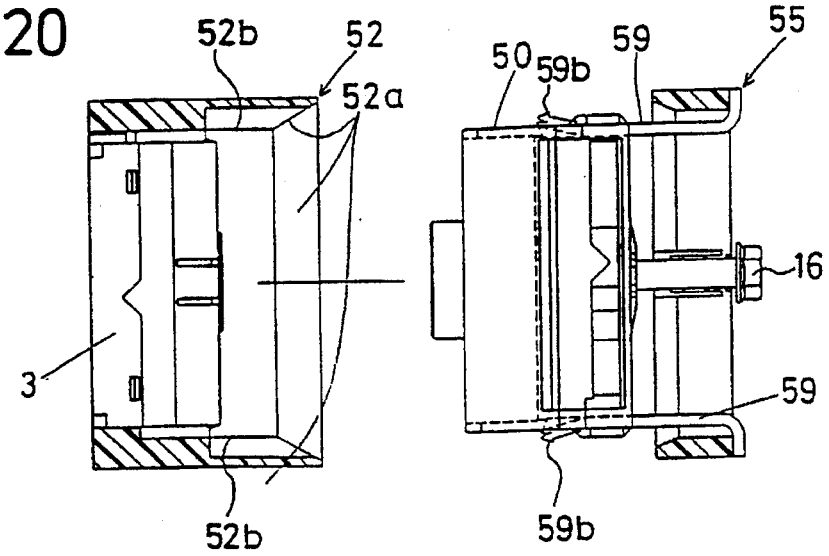
FIG. 20 shows the structure of a connector arrangement for vehicles according to the fourth embodiment of the present invention and is a sectional view taken on line F—F of FIG. 17.

FIG. 16 shows a third embodiment of the present invention. Similar or identical parts of the first embodiment are denoted by identical reference numerals, and different parts are mostly described.

In the structure of a connector arrangement for vehicles according to this third embodiment, a plurality of slide arms 49 are formed on distal ends of support portions 49*a* serving as weak portions. Each slide arm 49 has a generally circular configuration in section. Forward escape-preventive stoppers 49*b*, 49*b* are formed on each slide arm 49. Slide grooves, not shown, corresponding to the slide grooves 26a of the first embodiment are formed in such a manner as to conform to the configurations of the slide arms 49 and support portions 49a.

Next, operation of the third embodiment will be described.

In the structure of a connector arrangement for vehicles according to the third embodiment, the slide arms 49 are generally of a circular configuration in section and formed on the distal ends of the support portions 49a. Accordingly, when inserted into the slide grooves 26a, the male connectors 10, 11 can be assembled into the floating case 45 from backward to forward of the automobile. As a consequence, attaching workability is good.

Since the remaining construction and operation are generally the same to those of the first embodiment, description thereof is omitted.

FIGS. 17 to 22 show a fourth embodiment of the present invention. Similar or identical parts of the first embodiment are denoted by identical reference numerals, and different parts are mostly described.

In the structure of a connector arrangement for vehicles according to this fourth embodiment, a plurality of slide arms 59 are formed on right and left inner walls of the floating case 55. Each slide arm 59 has a generally U-shaped configuration in section and includes a weak portion at its basal portion. A forward escape-preventive stopper 59b is formed on the distal end of each slide arm 59. Escape-preventive portions 55c are elastically deformably formed on upper and lower inner wall surfaces of the floating case 55. Slide grooves 56, 56 corresponding to the slide grooves 26a of the first embodiment are integrally formed in the male connectors 50, 51, respectively.

A plurality of guide surfaces 52a inclining toward the opening are formed in upper and lower, right and left inner wall surfaces of the fixed bracket 52.

Operation of this fourth embodiment will now be described.

Figure 21:
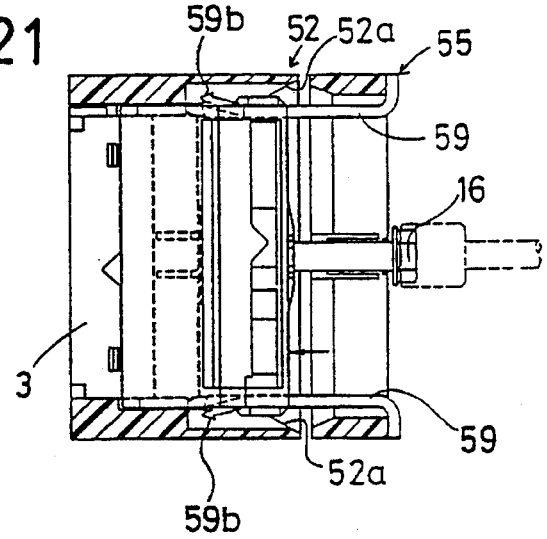
FIG. 21 shows the structure of a connector arrangement for vehicles according to the fourth embodiment of the present invention and is a sectional view taken on line F—F of FIG. 17.
Figure 22:
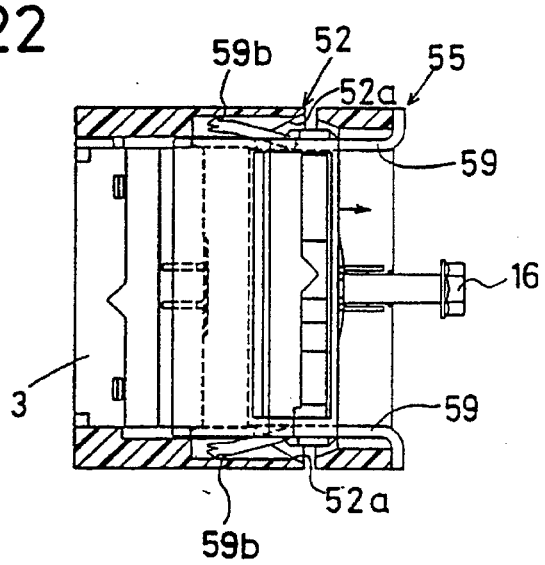
FIG. 22 shows the structure of a connector arrangement for vehicles according to the fourth embodiment of the present invention and is a sectional view taken on line F—F of FIG. 17.

In the structure of a connector arrangement for vehicles according to the fourth embodiment, when the slide arms 59 are inserted respectively into the slide grooves 56, 56, the male connectors 50, 51 are arranged in a so-called floating state in which the male connectors 50, 51 can be displaced upwardly and downwardly, rightwardly and leftwardly and moved in the fitting direction of the connectors. In this state, when the male connectors 50, 51 are brought toward the fixed bracket 52 as shown in FIG. 21, the male connectors 50, 51 are slid backwardly of the automobile, guided by the guide surfaces 52a and straight portions 52b, and positioned relative to upward and downward, rightward and leftward directions, so as to be temporarily fitted as shown in FIG. 21.

Remaining construction and operation are generally the same to those of the first embodiment and description thereof is omitted.

Figure 23:
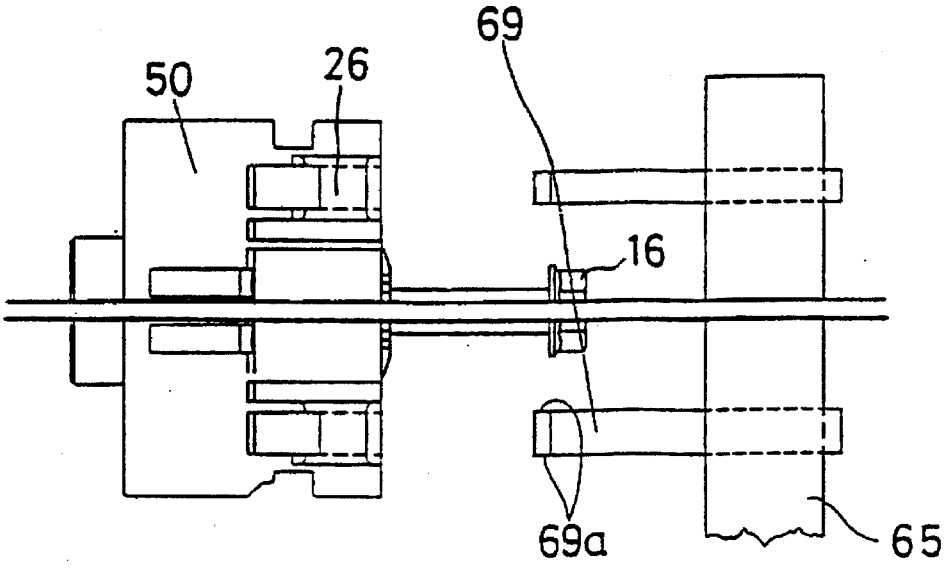
FIG. 23 is an upper surface view showing a structure of a connector arrangement for vehicles according to a fifth embodiment of the present invention.
Figure 24:
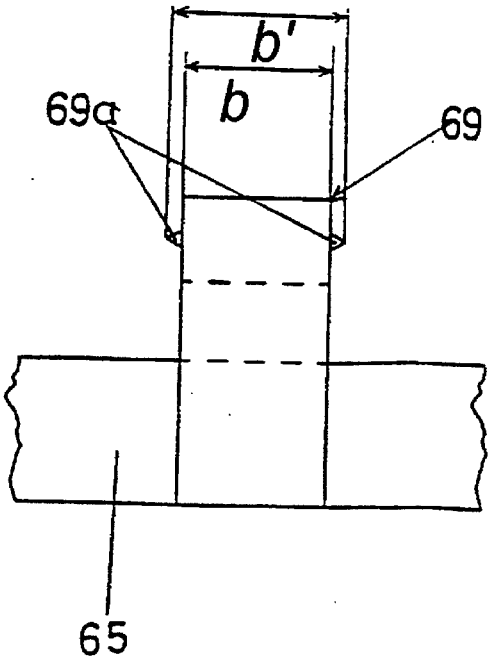
FIG. 24 is a partly enlarged upper surface view showing the structure of a connector arrangement for vehicles according to the fifth embodiment of the present invention.

FIGS. 23 and 24 show a fifth embodiment of the present invention. Similar or identical parts of the fourth embodiment are denoted by identical reference numerals, and different points will be mostly described.

In the structure of a connector arrangement for vehicles according to this fifth embodiment, a plurality of slide arms 69 are formed on right and left inner walls of the floating case 65. Each slide arm 69 has a generally U-shaped configuration in section and is formed at its distal end with slide resisting portions 69a. The width b' of each slide arm 69 including the slide resisting portion 69a is wider than the width b of the slide arm 59 slightly wider than the width of the slide groove 56 of the fourth embodiment so that when it is inserted, somewhat resistance is encountered. A basal end portion of each slide arm 59 is defined as a weak portion.

Operation of this fifth embodiment will now be described.

In the structure of a connector arrangement for vehicles according to the fifth embodiment, when the slide arms 59 . . . are inserted into the slide grooves 56, 56 respectively, the male connectors 50, 51 are slidably disposed in the floating case 65, such that the slide arms 59 . . . can be displaced upwardly and downwardly, rightwardly and leftwardly and moved in the fitting direction of the connectors. In other words, the male connectors 50, 51 are held in a so-called floating state, having a constant resistance. In this state, when the male connectors 50, 51 are brought toward the fixed bracket 52, the male connectors 50, 51 are slid backwardly of the automobile while having a constant resistance, guided by the guide surfaces 52a and straight portions 52b so as to be positioned relative to the upward and downward, rightward and leftward directions, and temporarily fitted.

For this reason, when compared with the structure of a connector arrangement for vehicles according to the fourth embodiment, the temporary fitting of this fifth embodiment is more and more resembling the regular fitting of each embodiment so far described. Moreover, the temporary fitting can be achieved with a simpler construction, and workability is good.

Since the remaining construction and operation are generally the same to that of the first embodiment, description will be described.

Figure 25:
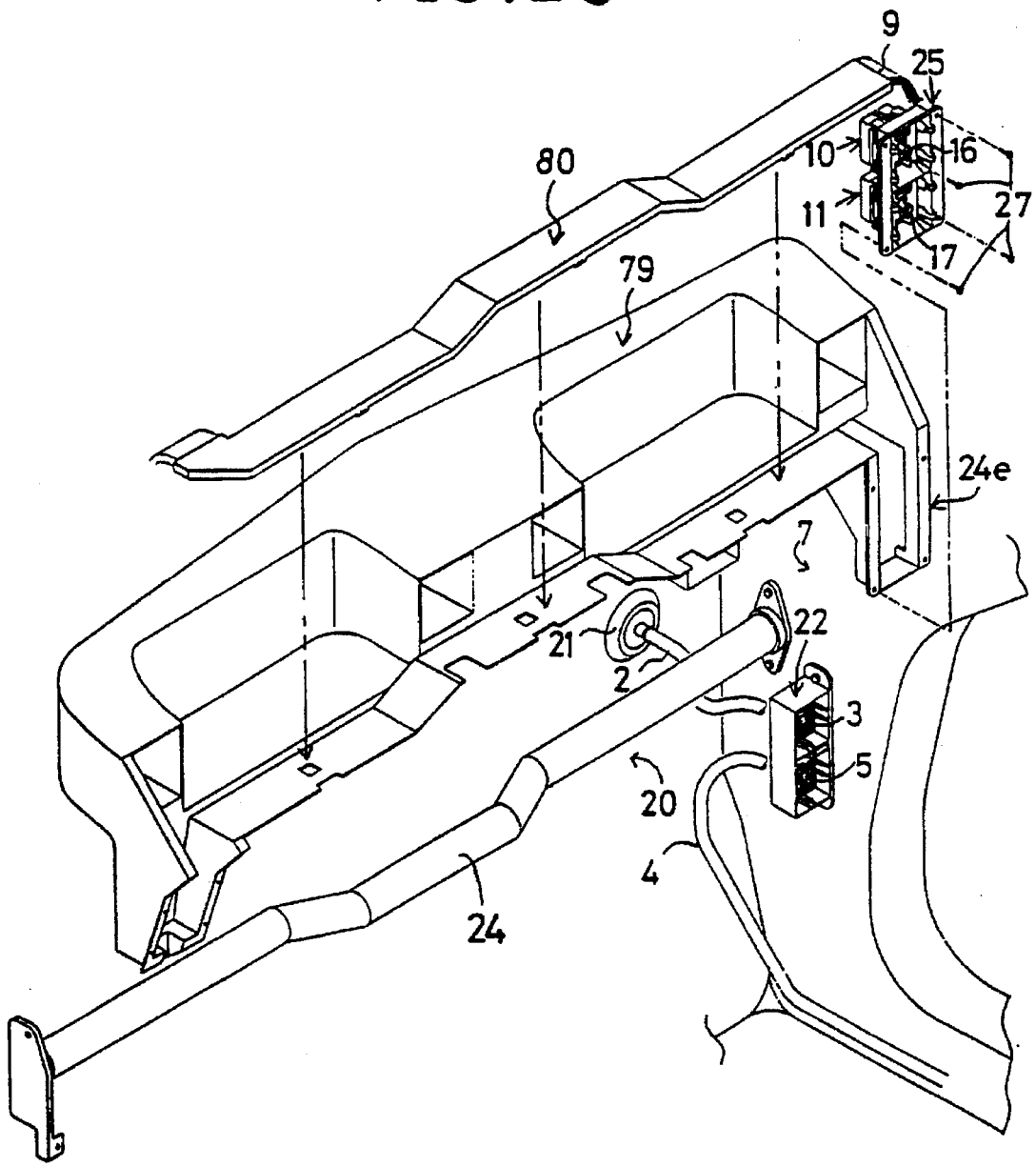
FIG. 25 shows a structure of a connector arrangement for vehicles according to a sixth embodiment and is an exploded perspective view showing an overall construction.
Figure 26:
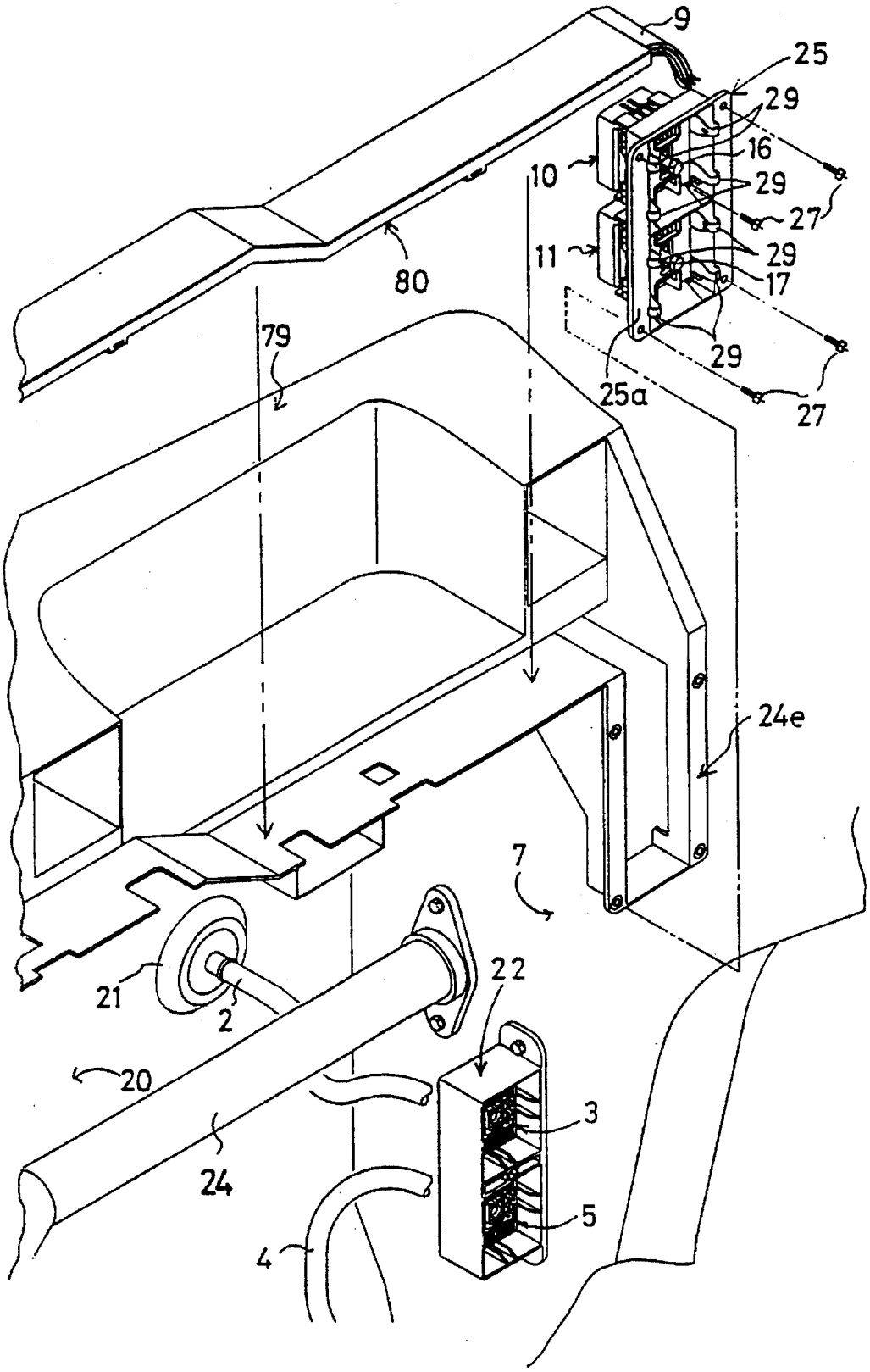
FIG. 26 shows the structure of a connector arrangement for vehicles according to the sixth embodiment of the present invention and is an exploded perspective view in which an important portion is shown in an enlarged scale.
Figure 27:
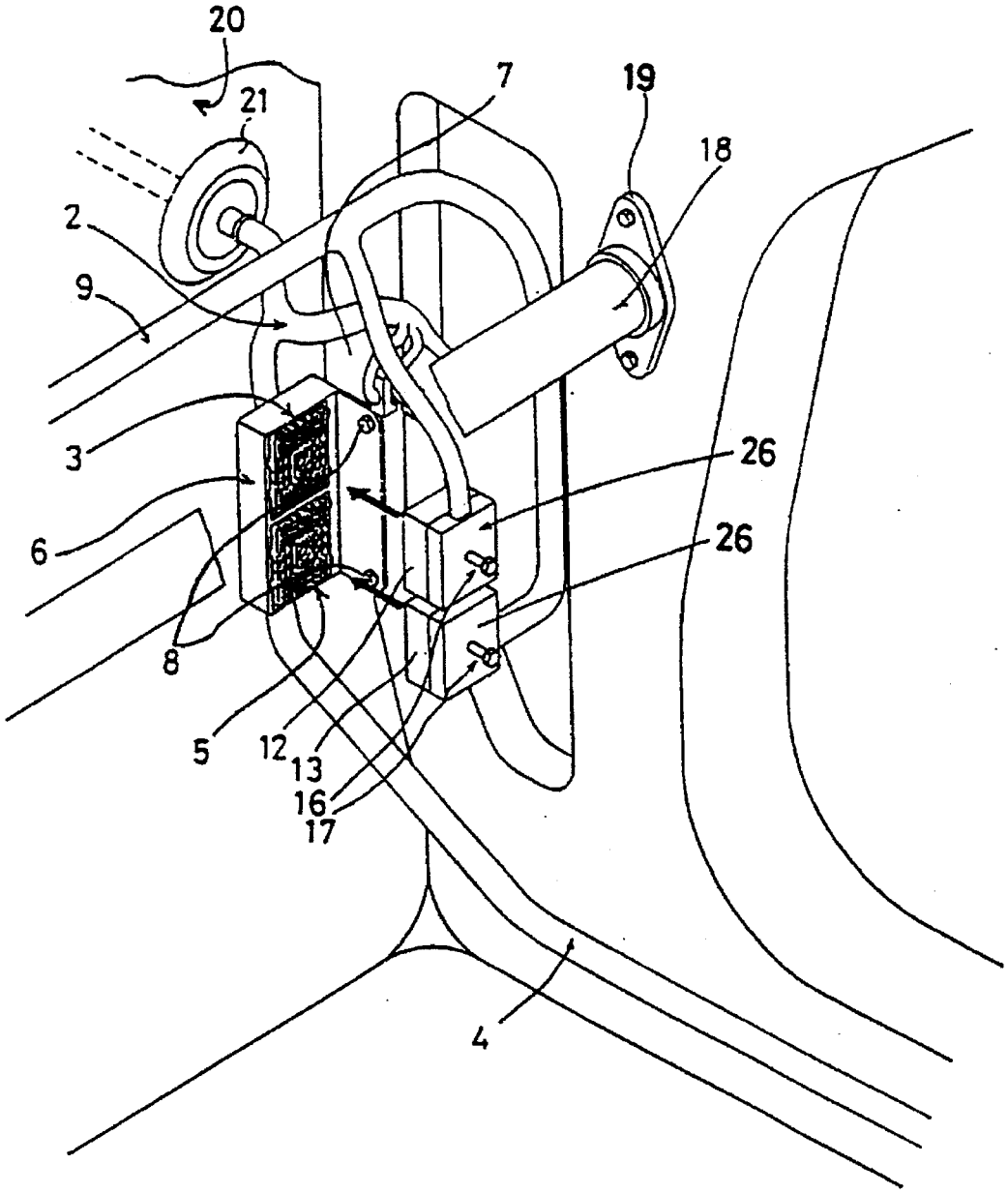
FIG. 27 (PRIOR ART)
FIG. 27 shows a structure of a conventional connector arrangement for vehicles and is an overall perspective view.
Figure 28:
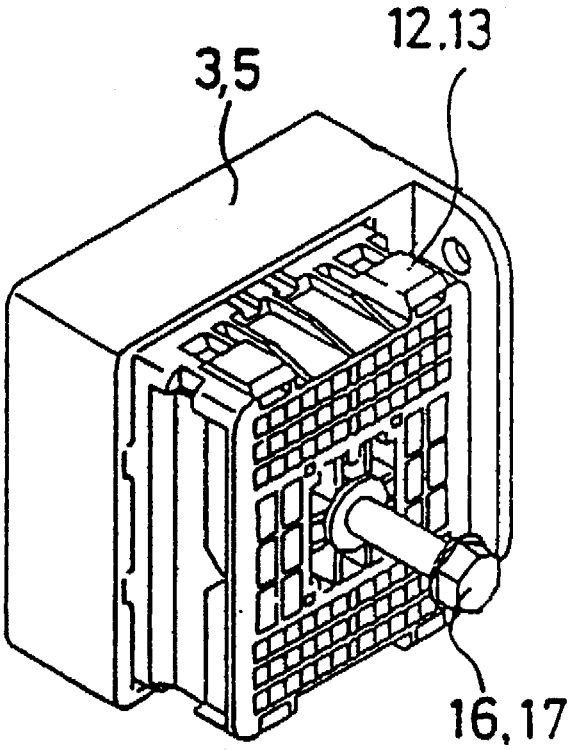
FIG. 28 (PRIOR ART)
FIG. 28 is a perspective view showing another structure of a connector arrangement for vehicles.

FIGS. 25 and 26 show a sixth embodiment of the present invention. Similar or identical parts of the first embodiment are denoted by identical reference numerals and different points will be mostly described.

In the structure of a connector arrangement for vehicles according to the sixth embodiment, a core instrument 79 is employed in the place of the steering member 24 of the first embodiment. The core instrument 79 serves as a base and extends in the direction of width of the automobile, within the instrument panel. The main harness 9 is attached to the core instrument 79 through a wire harness protector 80 formed of resin material.

As shown in FIG. 26, the fixed frame 24e serving as a bracket is integrally formed on a lower surface of a right end portion of the core instrument 79 and allowed to extend toward a lower part of the core instrument 79. The floating case 25 is attached to the fixed frame 24e by inserting the machine screws 27 into the attaching holes 28 formed in the peripheral portion 25a of the floating case 25 and screwing the machine screws 27 tight to the fixed frame 24e. The floating case 25 serves as a floating means in which the male connectors 10, 11 are disposed.

Operation of this sixth embodiment will now be described.

In the structure of a connector arrangement for vehicles according to the sixth embodiment, the main harness 9 is wired beforehand along the core instrument 79 extending in the direction of width of the automobile. Accordingly, by attaching the core instrument 79, the female connectors 3, 5 and male connectors 10, are temporarily fitted to each other, and then, they can be easily regularly fitted to each other by tightening the fixing bolts 16. Furthermore, the wiring operation of the main harness 9 is substantially completed by the attachment of the core instrument 79, and the assembling work can be performed smoothly.

Since the remaining construction and operation are generally the same to those of the first embodiment, description thereof is omitted.

As described in the foregoing, according to the present invention, the following effects can be obtained.

According to the present invention, since the second connector is attached to the bracket of the steering member, this second connector is temporarily fitted to the first connector during the time the steering member is attached to the body of the automobile.

At that time, since the second connector displaceably supported by the floating means for displacement relative to the bracket, the regular fitting can be easily performed by the regular fitting means even in the case where the temporary fitting position is slightly displaced.

For this reason, the number of processes for forcing the worker to take, for example, a somewhat awkward attitude as often experienced in the prior art, can be reduced and therefore, attaching workability is good.

Similarly, according to the present invention, since the wire harness is wired along the steering member, the wiring operation of the wire harness is substantially completed by the attachment of the steering member, and the assembling work can be performed smoothly.

Similarly, according to the present invention, since the wire harness is wired along the base extending in the direction of width of the automobile, the wiring operation of the wire harness is substantially completed by the attachment of the base, and the assembling work can be performed smoothly.

Similarly, according to the present invention, the floating means supports the second connector such that the second connector can be displaced upwardly and downwardly, rightwardly and leftwardly and moved in the fitting direction of the connector. Accordingly, when the second connector is to be regularly fitted to the first connector after they are temporarily fitted to each other, the regular fitting can be performed while moving the second connector in the fitting direction of the connector. Therefore, a reliable connection can be obtained.

Similarly, according to the present invention, since the second connector can be inserted into the bracket from backward to forward of the automobile, the sequential steps for assembly can be more freely selected. Moreover, owing to provision of the escape-preventive portion which is adapted to prevent the escape in the inserted state, there is no worry about the accidental escape, etc. even in the temporarily fitted state. Therefore, reliability is high.

What is claimed is:

1. A structure of a connector arrangement for vehicles, comprising:

male or female connectors (3, 5) fixed to an inner wall (7) of a vehicle body;

a bracket (24*e*) disposed on a harness wiring member (24), said bracket (24*e*) facing said male or female connectors (3, 5);

floating means (25) fixed to said bracket (24*e*);

a connector holding portion (29, 32) formed on said floating means (25); and corresponding connectors (10, 11) respectively corresponding to said male or female connectors (3, 5), said corresponding connectors (10, 11) being supported by said connector holding portion (29, 32) displaceably in upward, downward, rightward, leftward directions or in upward, downward, forward, and backward directions with respect to the vehicle body;

wherein when said harness wiring member (24) is fixed to the vehicle body, said corresponding connectors (10, 11) are displaced by said connector holding portion (29, 32) so as to face said male or female connectors (3, 5) and are temporarily fitted to said male or female connectors (3, 5) and then corresponding connectors (10, 11) are regularly fitted to said male or female connectors (3, 5) by means of regular fitting members (16, 17).

2. A structure of a connector arrangement for vehicles according to claim 1, wherein said harness wiring member is a part of a steering member which extends in the direction of width of the vehicle body and is fixed to the inner wall of the vehicle body.

3. A structure of a connector arrangement for vehicles according to claim 1, wherein said harness wiring member is a base forming a part of a steering member which extends in the direction of width of the vehicle body and is fixed to the inner wall of the vehicle body.

4. A structure of a connector arrangement for vehicles according to claim 1, wherein said connector holding portion (29) has an escape-preventive portion for regulating the displacement in the fitting direction of said corresponding connectors (10, 11).

5. A structure of a connector arrangement for vehicles according to claim 1, wherein said connector holding portion (29, 32) is a plurality of elastic pieces which extend in a direction in which said corresponding connectors (10, 11) are fitted and which are engaged with said corresponding connectors (10, 11) so that said corresponding connectors (10, 11) can displace not only in the upward, downward, rightward, and leftward directions or in the upward, downward, forward, and backward directions with respect to the vehicle body but also in the direction in which said corresponding connectors are fitted (10, 11).

6. A structure of a connector arrangement for vehicles according to claim 5, wherein said connector holding portion (29) is curved in the form of a U-shape at an end thereof at which said corresponding connectors (10, 11) begin to be fitted, so as to serve as a guide when corresponding connectors (10, 11) are attached to said floating means (25).

7. A structure of a connector arrangement for vehicles according to claim 5, wherein said connector holding portion (29) has a rearward escape-preventive stopper (29*c*) formed in a middle thereof, said rearward escape-preventive stopper (29*c*) being engaged with said corresponding connectors (10, 11) so that said corresponding connectors (10, 11) are prevented from displacing in a direction opposite to the fitting direction of said corresponding connectors (10, 11).

8. A structure of a connector arrangement for vehicles according to claim 5, wherein said connector holding portion (29) has erroneous-combination preventive projections (30, 31) projecting from an end thereof at which said corresponding connectors (10, 11) begin to be fitted, said erroneous-combination preventive projections (30, 31) regulating a direction in which said corresponding connectors (10, 11) are combined.

* * * * *